US006893122B2

(12) United States Patent
Shima et al.

(10) Patent No.: US 6,893,122 B2
(45) Date of Patent: May 17, 2005

(54) IMAGE FORMING APPARATUS

(75) Inventors: Kazunobu Shima, Wakayama (JP); Hidetoshi Nishikawa, Wakayama (JP); Masazumi Ishikawa, Wakayama (JP)

(73) Assignee: Noritsu Koki Co., Ltd., Wakayama-Ken (JP)

( * ) Notice: Subject to any disclaimer, the term of this patent is extended or adjusted under 35 U.S.C. 154(b) by 34 days.

(21) Appl. No.: 10/365,328

(22) Filed: Feb. 12, 2003

(65) Prior Publication Data

US 2003/0161552 A1 Aug. 28, 2003

(30) Foreign Application Priority Data

| | | |
|---|---|---|
| Feb. 14, 2002 | (JP) | 2002-036979 |
| Feb. 14, 2002 | (JP) | 2002-036983 |
| Mar. 15, 2002 | (JP) | 2002-071443 |
| Apr. 17, 2002 | (JP) | 2002-114494 |

(51) Int. Cl.[7] ..... B41J 2/01; H05B 1/00; H05B 11/00; H05B 3/00

(52) U.S. Cl. ..... 347/102; 219/216

(58) Field of Search ..... 347/102; 219/216; 399/67, 69

(56) References Cited

U.S. PATENT DOCUMENTS

| | | | |
|---|---|---|---|
| 5,214,442 A | 5/1993 | Roller | |
| 5,638,098 A | 6/1997 | Iwata et al. | |
| 6,048,059 A | 4/2000 | Wafler | |

FOREIGN PATENT DOCUMENTS

| | | | |
|---|---|---|---|
| EP | 0 307 251 A2 | 3/1989 | |
| JP | 63317351 | 12/1988 | |
| JP | 03021456 | 1/1991 | |
| JP | 06-161196 | * 6/1994 | ..... 399/111 |
| JP | 08-311782 | 11/1996 | |
| JP | 10-016188 | 1/1998 | |
| JP | 10-230589 | 9/1998 | |
| JP | 10-297197 | 11/1998 | |
| JP | 2001-105638 | 4/2001 | |

OTHER PUBLICATIONS

Patent Abstracts of Japan, vol. 013, No. 334—Jul. 27, 1989 (JP 01 110962).

Patent Abstracts of Japan, vol. 017, No. 137, Mar. 22, 1993 (JP 04 307865).

Patent Abstracts of Japan, vol. 2000, No. 21, Aug. 3, 2001 (JP 2001 088276).

* cited by examiner

*Primary Examiner*—Michael S. Brooke
(74) *Attorney, Agent, or Firm*—Fulbright & Jaworski L.L.P.

(57) ABSTRACT

An image forming apparatus for forming an image on a recording medium by heating the medium having ink applied to its surface layer by a heater device, thereby to fix the ink applied to the surface layer to a fixing layer of the recording medium. A heating controlling section (78) for controlling the heater device (4) includes a fixing behavior evaluating means (9) for evaluating a fixing behavior of the ink to the fixing layer and then outputting a control amount to the heating controlling section (78) for controlling the heater device (4). The fixing behavior evaluating means (9) includes such functions as a sublimation degree evaluating function for evaluating a sublimation degree of the ink in the recording medium (1), a function for evaluating surface temperature distribution of the recording medium or a transferred energy evaluating function for evaluating transferred energy received by each area of the recording medium (1).

4 Claims, 21 Drawing Sheets

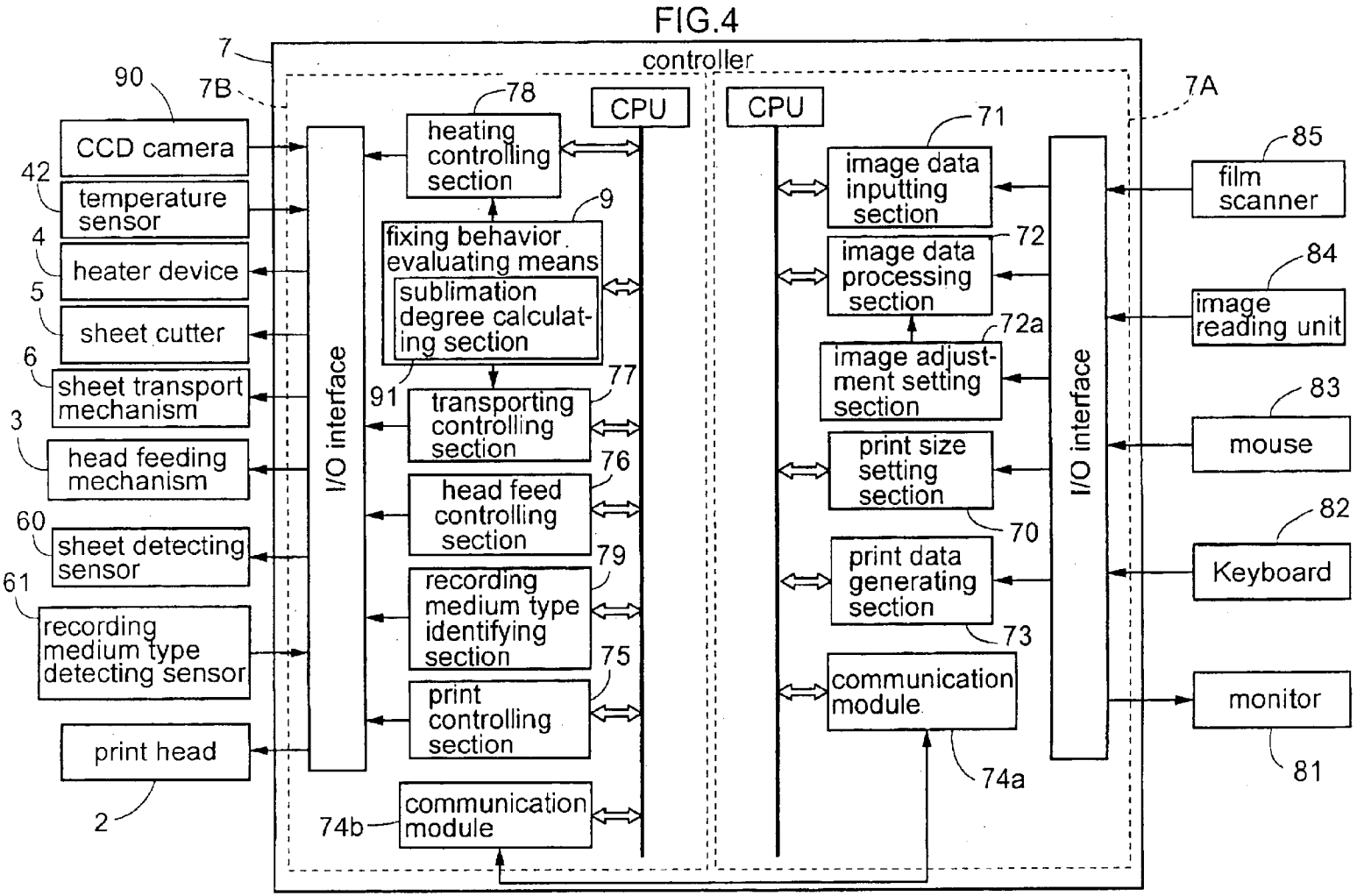
FIG.4
controller
7A
7
7B
CPU
CPU
I/O interface
I/O interface
image data inputting section
image data processing section
image adjust-ment setting section
print size setting section
print data generating section
communication module
heating controlling section
fixing behavior evaluating means
sublimation degree calculat-ing section
transporting controlling section
head feed controlling section
recording medium type identifying section
print controlling section
communication module
film scanner
image reading unit
mouse
Keyboard
monitor
CCD camera
temperature sensor
heater device
sheet cutter
sheet transport mechanism
head feeding mechanism
sheet detecting sensor
recording medium type detecting sensor
print head
85
84
83
82
81
71
72
72a
70
73
74a
78
9
91
77
76
79
75
74b
90
42
4
5
6
3
60
61
2

IMAGE FORMING APPARATUS

BACKGROUND OF THE INVENTION

1. Field of the Invention

The present invention relates to an image forming apparatus for forming an image on a recording medium by heating the medium having ink applied to its surface layer by a heater device, thereby to fix the ink applied to the surface layer to a fixing layer of the recording medium.

2. Description of the Related Art

An exemplary conventional technique relating to the above field of art is disclosed in Japanese patent application "Kokai" No: Hei. 10-297197. According to this, a metal substrate includes a coloring ground layer acting also as a rust-preventive layer, a transparent resin layer as an optical transparent resin layer formed over the coloring ground layer, the resin layer being made of acrylic resin, polyester resin, urethane resin etc., and an inkjet receiving layer formed over the resin layer and made of e.g. porous alumina. After application of a sublimating ink or pigment on the inkjet receiving layer by an inkjet printing, the sublimating pigment is heated in a heating furnace or by a hot press, whereby the sublimating pigment in the inkjet receiving layer is sublimed into the transparent resin layer. Then, the inkjet receiving layer is removed to obtain an ornamental metal body having a colored pattern fixedly formed within the transparent resin layer.

According to further art disclosed by Japanese patent application "Kokai" No: 2001-105638, sublimating ink is transferred from an ink ribbon onto a surface of a recording sheet. In order to heat and fix the ink on the sheet, the sheet is charged into a heater box, in which the sheet is advanced and heated between a press roll and a heat roll opposed to each other with a small gap therebetween or between a heat roll and a conveyer belt disposed along a portion of the peripheral face of the heat roll, and then the sheet is discharged from the heater box immediately.

Further, in the field of textile printing, according to an exemplary technique disclosed by Japanese patent application "Kokai" No: Hei. 08-311782, dye is applied to a textile by the inkjet printing method. Then, in order to reinforce the fixing of the dye and also to improve its color development, the textile is charged into a heater device to be heated therein. Then, the textile is discharged from the device immediately to be cooled at the room temperature.

Still further, Japanese patent application "Kokai" No: Hei. 10-16188 discloses an image forming apparatus. According to this, first, a primary image is formed on a thermal transfer sheet by e.g. an inkjet printer. Then, this thermal transfer sheet having the image formed thereon is laid over a recording sheet and these sheets are pressed and heated together, whereby the image (ink) formed on the thermal transfer sheet will be sublimed by the heat and transferred onto an ink fixing layer of the recording sheet, thus forming a secondary image thereon. With this, a finished printed product is obtained.

Another image forming apparatus is known from Japanese patent application "Kokai" No: Hei. 10-230589. According to this, a laminated material layer is provided in advance on an ink fixing layer of a recording sheet. Then, an image is formed on the laminated material layer by e.g. an inkjet printer. Then, the resultant sheet is pressed and heated by heat rolls, thereby to make the laminated material layer transparent and also to fix the ink pigment on the fixing layer. With this, a finished printed product is obtained.

With these image forming apparatuses, sublimating ink is discharged against the recording medium which usually is being transported along a sub-scanning direction, so that an image is formed thereon with ink droplets (here, these will be referred to as "un-sublimated print dots"). Then, during the subsequent heat fixing process, these ink droplets are heated to sublime, so that the sublimed ink pigment (referred to here as "sublimed print dots") is fixed in the fixing layer of the recording medium, whereby a final printed image formed of the sublimed print dots is obtained.

For this reason, the heating behavior of the ink in the fixing layer during the above heat sublimating process is crucial as this provides determinant effect on the sublimation fixing characteristics, consequently significantly affecting the quality of the printed product as the finished product. This heating behavior, that is, the sublimation fixing characteristics, depends on such factors as the type of ink and/or of the recording medium used and the specific mode of heat sublimating method employed. Referring to one example, according to a finding of the present inventors, there is observed reducing tendency in the density of the final image (sublimated print dots) in case the heating of the recording medium by the heater device during the heat sublimation process is insufficient in terms of the duration and/or temperature of the heating. Conversely, with excessive heating, there is observed occurrence of ink bleeding, which results in disadvantageous reduction in the sharpness of the image. According to one reasonable explanation for this, insufficient heating causing insufficient sublimation of the ink droplets provides sublimated ink dots of insufficient density, whereas over-sublimation of the ink due to excessive heating results in significant diffusion of the ink pigment, producing blurred sublimed print dots.

SUMMARY OF THE INVENTION

In view of the above-described state of the art, a primary object of the present invention is to provide an improvement over the conventional image forming apparatus described at the onset, the improved apparatus being capable of appropriate controlling of the heating behavior for the recording medium to allow its heat sublimation fixing process to take place in an optimal manner.

For accomplishing the above-noted object, an image forming apparatus according to the present invention comprises a fixing behavior evaluating means for evaluating a fixing behavior of the ink to the fixing layer and then outputting a control amount to a heating controlling section for controlling the heater device.

With this construction, it becomes possible to constantly provide the recording medium with an appropriate heating amount, whereby an image with higher quality may be obtained.

Preferably, the fixing behavior evaluating means adjusts the control amount depending on the type of the recording medium. With this, in the case of a type of recording medium having a thicker fluororesin layer (which has to be traversed by the sublimated vapor of the ink pigment) than the standard type medium, this type of recording medium requires a greater amount of heat for appropriate sublimation and fixation than the standard type. So, such greater amount of heat may be provided to this medium (specifically, the heating temperature will be raised, or the heating duration will be extended, without changing the heating temperature). In this manner, for variety of types of recording medium, the heating thereof may be effected to suit each particular type of recording medium employed. As a result, its sublimation degree will be appropriate, whereby a printed image with appropriate density may be obtained.

Preferably, the fixing behavior evaluating means adjusts the control amount depending on environment conditions including at least one of temperature and humidity. The image forming apparatus with this feature can constantly provide a quality image with appropriate heat fixing operation, regardless of in the environmental conditions or possible variations thereof, such as the room temperature and/or humidity or the atmospheric pressure to which the apparatus is exposed.

Preferably, the fixing behavior evaluating means adjusts the control amount depending on the type of ink born on the ink receiving layer of the recording medium. With this, when the image forming apparatus appropriately uses one type of recording medium from plural types thereof requiring different heating conditions for providing a predetermined density and/or resolution to a final fixed image to be formed thereon, the apparatus can always provide an optimal heating amount to the recording medium. As a result, an image of higher quality can be formed in an efficient manner.

Preferably, the fixing behavior evaluating means adjusts the control amount depending on the pattern of the image to be formed on the fixing layer. With this feature, the heating amount may be appropriately varied in the heating area, depending on whether the image to be formed on the ink receiving layer comprises an image of text document having a standard line spacing or the image comprises e.g. a photographic image having a standard resolution (e.g. 300 dpi). Hence, it is possible to always provide just necessary and sufficient heating amount to the medium, regardless of the type of image to be formed thereon. As a result, an image with higher quality may be formed in an efficient manner. That is, in the case of a conventional photographic image, its pixels are to be formed over the entire or substantially entire printable area of the recording medium. Hence, this type of image requires a large amount of ink. Therefore, if the heat amount to be applied to the recording medium in the heating area were fixed regardless of the environmental conditions or if the temperature of the heating area were fixedly maintained, such simple control scheme would result in inconvenience as follows. Namely, the greater the amount of the ink applied on the recording medium according the image pattern, the longer for the recording medium to take to reach a predetermined heating temperature in the heating area (especially, when a water-based ink containing sublimating pigment is employed, the heat fixing process to be effected in the heating area will involve a preliminary process for evaporating the water content of the ink away from the recording medium. Thus, not only the heat amount required for sublimation of pigment which is the object of the invention, but also the heat amount required for such preliminary process will greatly vary depending on the type of the image to be formed). As a result, the retention period of the medium at the appropriate heating temperature will be insufficient. However, if the heat amount to be applied is adjusted depending on the image pattern as proposed by the invention, the amount of heat to be applied in the heating area may be increased by an amount corresponding to the large amount of ink applied on the recording medium, whereby the medium may receive an appropriate amount of heat.

Preferably, the fixing behavior evaluating means adjusts the control amount depending on a passage speed for the recording medium to pass inside the heater device. With this feature, it becomes possible to constantly provide an appropriate amount of heat to the recording medium, regardless of change in a discharging speed of the recording medium from a printing unit. As a result, with appropriate sublimation degree, an image of appropriate density may be fixed and formed on the medium. For instance, relative to a standard image comprising only text document having the standard line spacing, the apparatus will adopt a much lower transportation speed for the recording medium M when printing a photographic image of standard resolution (e.g. 300 dpi). Therefore, the apparatus would be unable to keep its basic heating conditions (e.g. 180° C.×2 min) for a certain standard combination of ink and recording medium, so that the recording medium would be retained too long in the heating area, resulting in excessive sublimation fixing and consequently excessive image density. One conceivable measure to cope with this problem would be implementation of a printing routine adapted for e.g. delaying feeding of the leading end of the print into the heating area until substantial completion of one print. This solution, however, results in disadvantageous reduction in the processing speed of the apparatus. On the other hand, according to the above-described solution proposed by the present invention, which adjusts the heat amount depending on the discharge speed of the recording medium from the printing unit, that is, in this particular case, if the heating conditions are changed to certain other heating conditions (e.g. 170° C.×5 min.) adapted for a lower processing rate and an image quality within a permissible range, appropriate sublimation fixing of the recording medium is possible without requiring interruption of the heat fixing process in the heating section.

According to one preferred embodiment of the invention, the fixing behavior evaluating means includes a sublimation degree evaluating function for evaluating sublimation degree of the ink applied to the recording medium and adjusts the control amount based on the evaluated sublimation degree. With this construction, by evaluating the sublimation degree which represents the degree of the heat sublimation of the un-sublimated print dots formed on the surface layer of the recording medium and associated fixation of the dots as sublimated print dots in the fixing layer of the recording medium, the heating behavior for the recording medium is controlled, whereby the heat sublimation fixing process may take place in an optimal manner.

Such sublimation degree evaluation may be realized by a sublimation degree calculating section for calculating the sublimation degree based on a density value of print dot obtained by an image pickup device for photographing the print dot formed on the recording medium. As the image formed by this image forming apparatus consists of a group of print dots as minimal constituents, the optimal heat sublimation fixing process may be determined by checking the density of these print dots.

As described hereinbefore, in the image forming process of the invention's apparatus, the un-sublimated print dots formed on the surface layer of the recording medium are heated and sublimed to be fixed as sublimated print dots in the fixing layer of the medium. Therefore, it may be said that the ink pigment directly relating to the density is transformed from the un-sublimated print dots to the sublimated print dots in the course of the heat sublimation process. Namely, as the heat sublimation fixing process proceeds, the density of the un-sublimated print dots is gradually reduced, while the density of the sublimated print dots is gradually increased correspondingly. For this reason, the sublimation degree may be determined based on such density reduction in the un-sublimated print dots or may alternatively be determined based on corresponding density increase in the sublimated print dots. Considering the fact that the un-sublimated print dots are formed on the surface layer of the recording medium and the sublimated print dots are formed on the fixing layer underlying the surface layer, it will be convenient that the sublimation degree determination is made for the un-sublimated print dots when the sublimation degree is to be determined from the front side of the recording medium and the determination is made for the sublimated print dots when the degree is to be determined from the back side of the recording medium.

As the print dots (un-sublimated print dots or sublimated print dots) subjected to the sublimation degree determination, it is first conceivable to utilize the print dots constituting the image to be actually printed, that is, print dots corresponding to predetermined pixels included in the image data as the print source data. This construction will be advantageous in a real time control scheme of the heat sublimation fixing process adapted for determining the sublimation degree characteristics based on a plurality of sublimation degrees obtained over time from a plurality of density values of the print dots measured over time and stopping the heating upon achievement of the optimal sublimation degree. As this construction measures the print dots as the constituents of the image actually printed, the construction will provide greater precision.

Alternatively, as the print dots subjected to the sublimation degree determination, it is also possible to obtain a print of a prepared test pattern and use print dots included in this test pattern. The combination of the heating temperature and the heating period required for realizing the heating behavior for obtaining the optimal sublimation degree does not necessarily vary for each print. Rather, change thereof requiring re-adjustment is due to such factors as a significant change in the print size or change in the environment temperature etc. For this reason, the control of the heating behavior by way of the sublimation degree evaluation may be effected not in real time, but in off-line manner appropriately. In such case, it will be convenient to re-adjust the control scheme for the heating behavior of the heater device through the above-described density evaluation using a test pattern. Specifically, an appropriate control amount is provided to the heating controlling section, based on a sublimation degree obtained from a recording medium on which the test pattern has been heated and fixed by a predetermined heating behavior.

As one preferred embodiment of the invention in the case of adopting the method of controlling the heating behavior in real time based on an evaluated sublimation degree, there is proposed a construction for retaining the recording medium within the heater device until an appropriate sublimation degree is achieved. Specifically, such construction for controlling the discharging speed of the recording medium from the heater device through adjustment of the transporting speed thereof or a further construction for keeping the recording medium inside the heater device until an appropriate sublimation degree is obtained are preferred.

In case such adjustment of the transportation speed is difficult due to certain restriction from the transporting mechanism or the image pickup device for the sublimation degree evaluation needs to be installed outside the heater device, it is also proposed to charge the recording medium into the heater device for a plurality of times until the appropriate sublimation degree is obtained. In charging the medium into the heater device for a plurality of times, it is possible to charge the recording medium once out of the heater device into the same from the opposite side, i.e. downstream side thereof. It is further possible to provide a transportation line which extends roundabout the heater device for re-charging the recording medium once discharged from the heater device into this heater device again from the same side, i.e. upstream side thereof.

According to another preferred embodiment of the invention, the heater device includes a plurality of heating sub-units distributed in a matrix pattern and the fixing behavior evaluating means includes a function for evaluating surface temperature distribution of the recording medium obtained by temperature sensor means for determining the surface temperature distribution of the recording medium and the control amount is adjusted in such a manner as to maintain the evaluated surface temperature distribution at a predetermined temperature distribution. With this construction, the heater device for applying necessary heat to the recording medium comprises a plurality of heating sub-units arranged in the form of a matrix. Therefore, it is possible to heat a desired area of a plurality of divided areas of the surface of the recording medium to be heated more strongly or less strongly than the other areas. That is, the surface temperature distribution of the recording medium will be obtained by the temperature sensor means comprising e.g. an infrared sensor and adapted for determining a surface temperature distribution of an object. Then, if local temperature increase or decrease is observed in a certain area, then, the amount of heat to be provided from a heating sub-unit corresponding to that particular area is decreased or increased correspondingly, whereby the surface temperature distribution of the recording medium may be rendered uniform. As a result, it is possible to restrict occurrence of deformation such as wrinkles or undulations, color irregularity or color development fault in the recording medium during its heating process. Hence, a high-quality printed product may be obtained.

In order to solve surface temperature abnormality or displacement occurring in a limited particular area, the above-described heating sub-units will be controlled individually of each other by the heating controlling section. In this regard, in order to allow thermal energy generated from each heating sub-unit to reach its corresponding single area in the recording medium without being mixed with thermal energies generated from the other heating sub-units, it is proposed to provide, between one heating sub-unit and an adjacent heating sub-unit, a partition wall capable of heat insulation therebetween.

As one specific construction of the above-described heater device employed by the invention, the heater device includes a single blower fan shared by at least a plurality of heating sub-units and a plurality of heater elements each incorporated within each heating sub-unit and controllable independently of each other. In the case of this construction, each heating sub-unit incorporates a heater element which is controlled independently of the heater elements incorporated in the other heating sub-units. And, the air current for sending the heat generated by its heater element to the corresponding area of the recording medium is provided from the common blower fan. That is to say, while the amounts of hot air currents to the respective areas of the recording medium are the same, the heat amounts contained in the respective currents may be adjusted independently for each heating sub-unit. Therefore, it is possible to cause the surface temperature distribution occurring in the recording medium to comply with the predetermined target distribution.

Conversely, the heater device may comprise a heater element shared by at least a plurality of heating sub-units and a plurality of blower fans each incorporated with each heating sub-unit and controllable independently. In the case of this construction, each heating sub-unit incorporates its own blower fan which can be controlled independently of the blower fans incorporated in the other heating sub-units. The air heated by the heating sub-unit is rendered into a hot air current by each blower fan to be supplied to the corresponding area of the recording medium. That is to say, with this construction, while the heat amounts per unit area contained in the hot air currents to the respective areas of the recording medium are the same, the amount of the hot air current to reach each area of the recording medium can be adjusted independently for each heating sub-unit. Therefore, it is possible to cause the surface temperature distribution occurring in the recording medium to comply with the predetermined target distribution.

According to a further embodiment of the invention, the recording medium is heated by the heating sub-units while being transported inside the heater device; and the temperature sensor means is capable of determining the surface temperature for each unit area of the recording medium delimited according to the matrix distribution pattern of the heating sub-units during the transportation of the recording medium. With this construction, the recording medium is heated while being transported within the heater device, so that the areas of the recording medium to be heated by the respective heating sub-units arranged in the matrix pattern in parallel with the surface of the recording medium will change with time. Therefore, areas sectioned according to the matrix arrangement of the heating sub-units will be set on the surface of the recording medium to be heated and the surface temperatures of the respective areas to be heated will be determined one after another over time while the medium is being transported. And, when an area with an abnormal surface temperature is found, then, at this timing, a particular heating sub-unit which is to provide heat to this particular area will be specified and adjusted for obtaining a predetermined target surface temperature distribution. That is to say, as the areas to be heated by the respective heating sub-units vary with time, the area to be heated will be determined with lapse of time.

Regarding the temperature sensor means, according one conceivable construction thereof, a plurality of infrared camera units are provided in a matrix pattern like that of the heating sub-units for obtaining images of the surfaces of the respective areas, so that the sensor means obtains the surface temperature of each area by processing a signal from the corresponding camera unit. In this case, if the recording medium is heated while being transported, the relationship between a particular area of the recording medium being transported and an infrared camera unit for obtaining the image of this particular area will be switched over one after another, so that the surface temperatures of all the areas provided on the recording medium may be obtained eventually. According to another possible construction, a single infrared camera capable of obtaining the image of the entire surface of the recording medium is provided. And, the thus photographed image is divided into a plurality of areas in the matrix pattern like that of the heating sub-units. Then, by switching over the correlation between these divided photographed image areas and the respective areas of the recording medium one after another, the surface temperatures of all the areas of the recording medium may be obtained eventually.

Selection between these possible constructions may be appropriately determined based on design requirements such as the installment space, measurement conditions, etc.

According to one preferred mode of heating sub-unit control, the target temperature distribution of the respective areas is set such that the temperature varies according to lapse of the heating period. And, for the initial stage of heating, the temperature will be set at a low temperature, preferably about 80° C., at which full-scale heat fixing process does not take place. And, for the later stage of the heating, the temperature will be set at a high temperature, preferably about 180° C., at which full-scale heat processing process takes place and thereafter the temperature will be set again at a low temperature, preferably about 80° C. Namely, according to a finding of the present inventors, by adopting such temperature distribution scheme which varies with lapse of the heating period, such as first elevating the surface temperature of the recording medium with mild slope up to the ink fixing temperature, then allowing the heat fixing process to continue with keeping the temperature constant and then finally lowering the surface temperature of the recording medium again with mild slope, it is possible to restrict occurrence of image quality deterioration such as wrinkles or undulations, color irregularity in the final printed product.

According to a still further preferred embodiment of the present invention, the heater device comprises a plurality of heating sub-units arranged in a matrix pattern like the above-described embodiment; and the fixing behavior evaluating means includes a transferred thermal energy evaluating function for evaluating transferred energy received by each area of the recording medium by effecting a time-base multiplication of the surface temperatures obtained by the temperature sensor means for determining the surface temperature distribution of the recording medium and the control amount is adjusted such that the evaluated transferred thermal energy may be maintained at a predetermined value. With this construction, since the heater device for applying to the recording medium the heat needed for fixing the ink permeated from the surface layer bearing the ink image onto the fixing layer comprises a plurality of heating sub-units arranged in the form of matrix. Then, it is possible to heat a desired area of the areas sectioned on the recording medium surface to be heated more strongly or weakly than the other areas. That is, the surface temperatures of the respective areas of the recording medium are obtained by the temperature sensor means comprising e.g. an infrared sensor, adapted for determining a surface temperature distribution of an object. Further, by effecting a time-base multiplication of these respective surface temperatures, the thermal energy received by each area of the recording medium is calculated. And, if it is observed this resultant value tending to deviate from the predetermined target value, then, the heat from a particular heating sub-unit corresponding to that area in question is increased or decreased correspondingly. As a result, the thermal energies to be applied to all the areas of the recording medium may be rendered into the predetermined target value. With this, even if there exists some irregularity in the temperature of the hot air current from the heater device to reach the recording medium or if there exists a tendency of the temperature of a certain portion of the recording area (e.g. its edge) more difficult to be elevated than those of the others, it is possible to restrict irregularity among the thermal energies to be eventually received by the respective areas of the recording medium. As a result, color irregularity and/or color development problem may be avoided advantageously, whereby a printed product with high image quality may be obtained.

Further and other features and advantages of the invention will become apparent upon reading the following detailed disclosure of preferred embodiments thereof with reference to the accompanying drawings.

BRIEF DESCRIPTION OF THE DRAWINGS

FIG. 4 is a functional block diagram illustrating functions of a controller.

DESCRIPTION OF THE PREFERRED EMBODIMENTS

Figure 1:
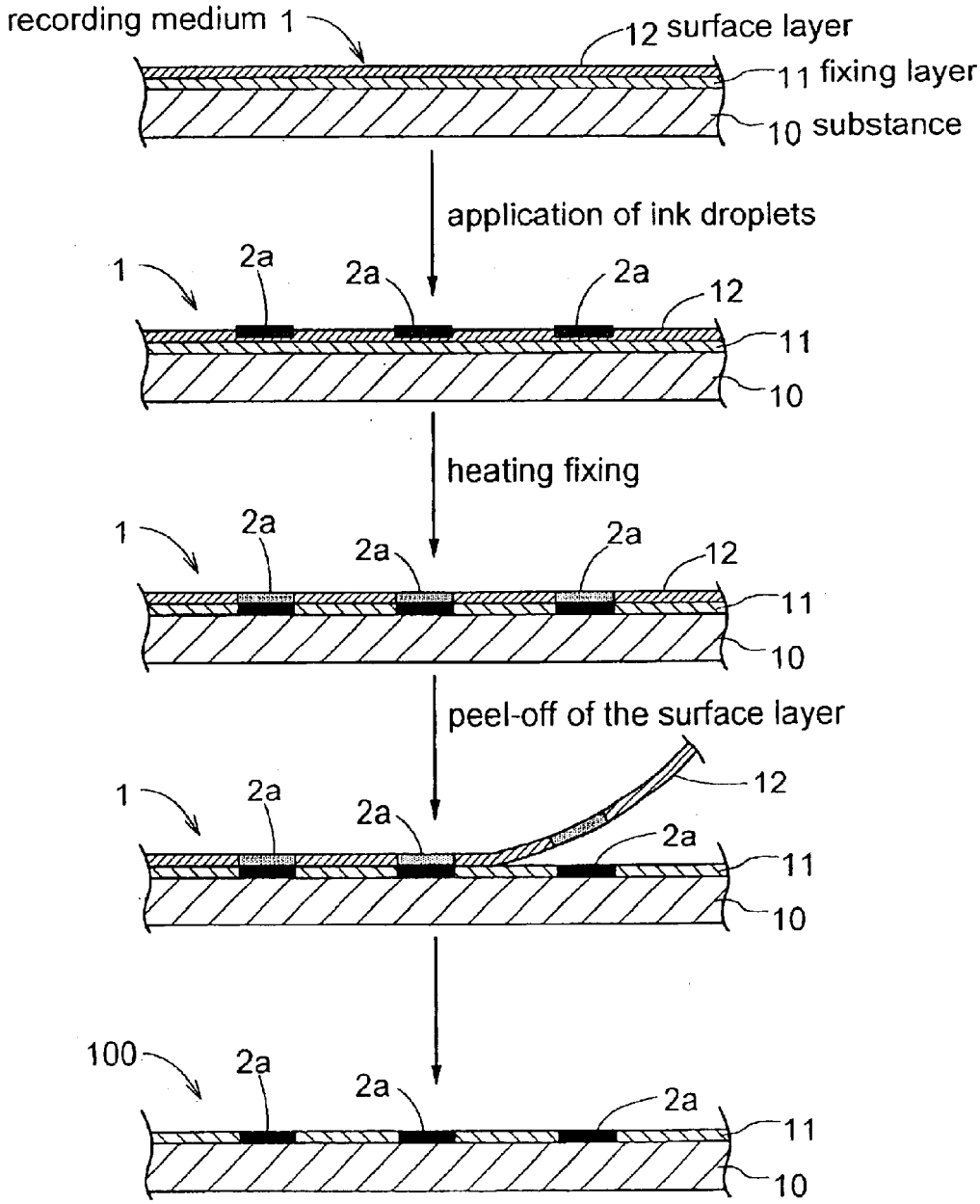
FIG. 1 is a section view showing an example of a recording medium to be handled by an image forming apparatus relating to the present invention.

First, an example of a recording medium 1 to be processed by the invention's image forming apparatus will be described with reference to FIG. 1. This recording medium 1 includes a substrate 10 made of a film sheet of e.g. PET (polyethylene terephthalate), a fixing layer 11 formed of e.g. urethane resin and placed over the surface of the substrate 10 for fixing therein ink, that is, ink pigment, and a surface layer 12 placed on the surface of the layer 11 and acting as a permeation layer allowing permeation of the ink therethrough. In case the surface of the substrate 10 has a property allowing direct fixation of the ink pigment thereon, the fixing layer 11 may be omitted. In use, sublimating ink droplets are applied by e.g. an inkjet printer to the surface layer 12 of this recording medium 1 to form thereon a printed image constituted from un-sublimated print dots, after which, when heated to an appropriate temperature, the ink droplets (un-sublimated print dots) applied on the surface layer 12 begin to sublime and permeate the surface layer 12 to reach the underlying fixing layer 11, so that the ink pigment, now as sublimated print dots, is fixed within the fixing layer 11. Accordingly, by removing or "peeling off" the surface layer 12, there will be obtained, as a final printed product 100, an image recorded sheet having high gloss and high image definition bearing the printed image formed of the sublimated print dots in its fixing layer 11. Namely, in this heating sublimating process, the ink pigment applied as un-sublimated print dots to the surface layer 12 permeates through the surface layer 12 to reach the fixing layer 11, where the pigment as sublimated print dots forms the printed image. Incidentally, as this recording medium requires, at the last stage, removal of the surface layer 12 from the fixing layer 11 or the substrate 10, it will be advantageous to provide a releasing agent therebetween.

Figure 2:
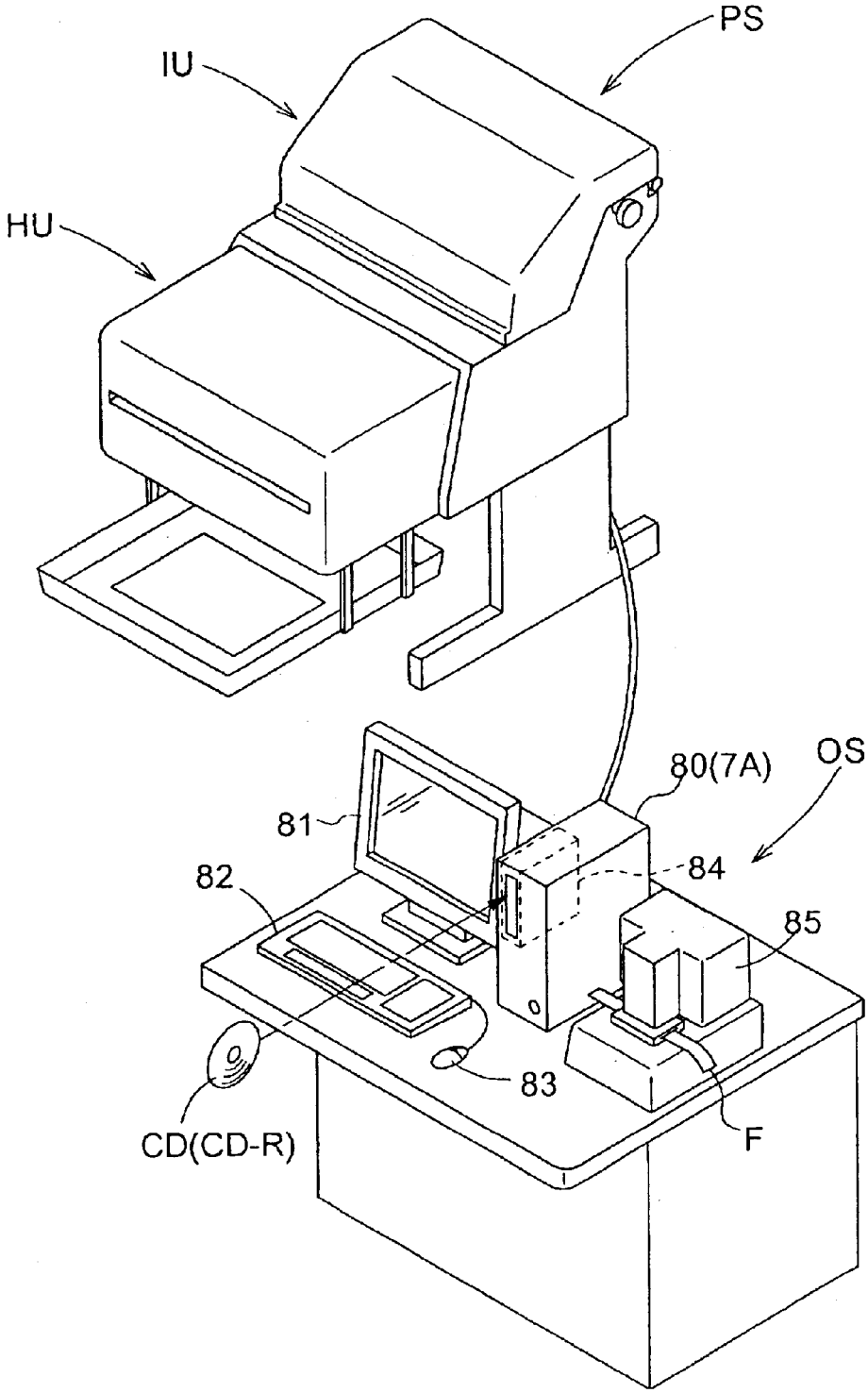
FIG. 2 is an appearance view showing an image forming apparatus according to one preferred embodiment of the invention.

Next, a first embodiment of an image forming apparatus for producing the final printed product 100 with using the above-described recording medium 1 will be described with reference to FIG. 2 and FIG. 3. As shown in FIG. 2, this image forming apparatus consists mainly of a printing station PS and an operator's station OS.

The printing station PS includes an inkjet type printing unit IU, a heating fixing unit HU mounted on the sheet discharging side of this inkjet printing unit IU and a cover for covering these units.

Figure 3:
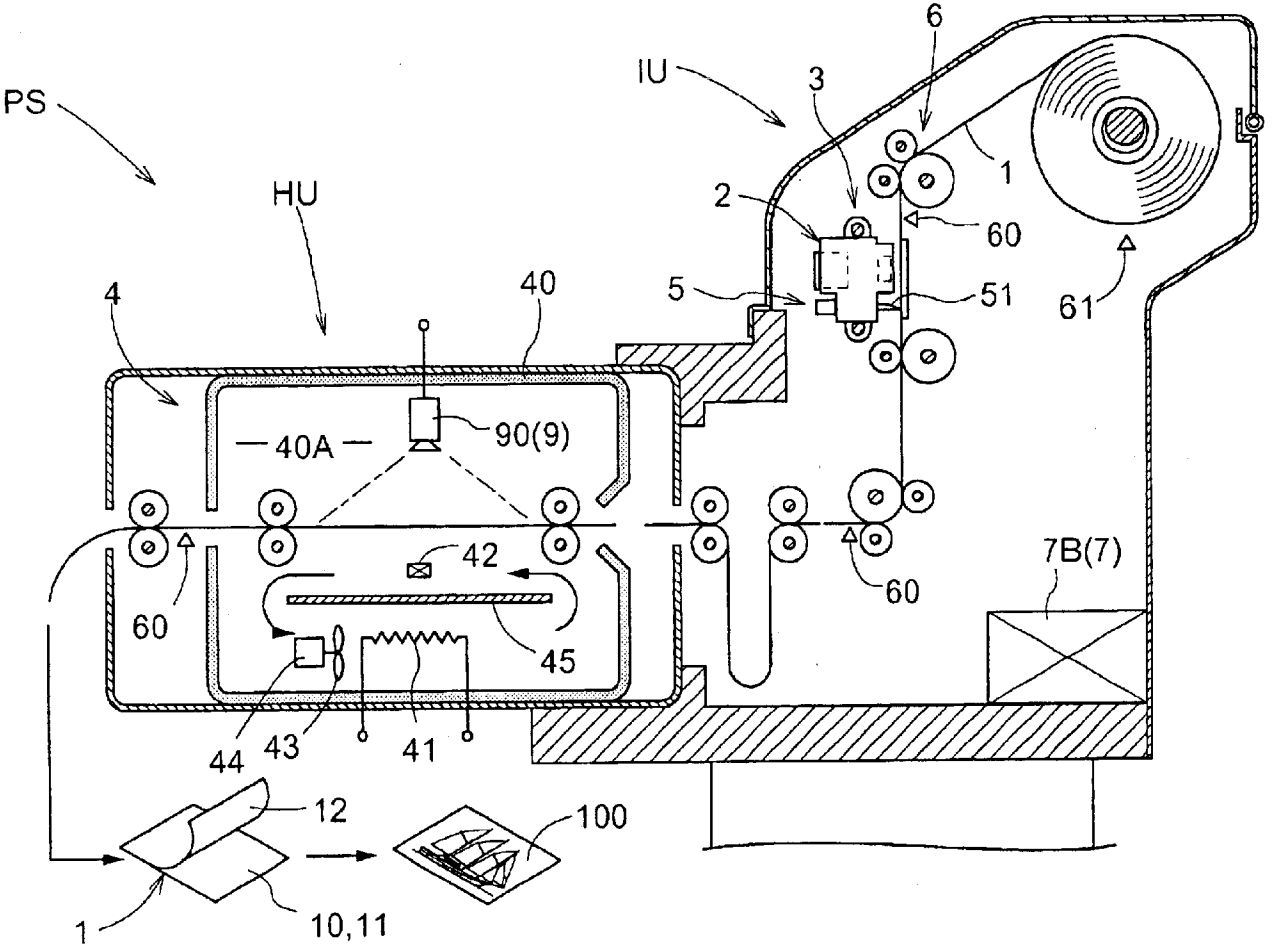
FIG. 3 is a schematic section showing construction of a printing station of the image forming apparatus.

As can be seen from FIG. 3, within the printing station PS, a sheet transport mechanism 6 transports the recording medium 1 while unwinding this recording medium 1 from an unillustrated roll-sheet cartridge in which the medium 1 is stored in the form of a roll, in such a manner that the surface layer 12, the printing surface, of the medium may be brought adjacent an ink discharging outlet of an inkjet type print head 2 as an example of a print head. The print head 2 is mounted to be movable back and forth by a head feeding mechanism 3 along a direction traversing the transporting direction of the recording medium 1, that is, along a main scanning direction. As the recording medium 1 is transported along a sub-scanning direction with each stroke of movement of the print head 2 discharging ink through its ink discharging outlet against the surface layer 12 of the recording medium 1, printed images will be formed in succession. The print head 2 includes a plurality of discharging outlet modules capable of respectively discharging inks of different principal colors in order to form a color printed image. For instance, if a color printed image of photographic quality is needed, in addition to inks of primary colors of cyan, magenta, yellow, black etc, further inks of tint colors of same kind will be generally used. The print head 2 may be a standard print head used in a conventional inkjet printer. Therefore, further description thereof will be omitted.

The recording medium 1 baring the printed image on its surface layer 12 with ink droplets 2*a* discharged from the inkjet head 2 is discharged from the inkjet printing unit IU and then sent to a heating fixing unit HU forming a heating fixing area where heating fixation of the ink to the fixing layer 1 is effected. This heating fixing unit HU includes a heater device 4.

With the recording medium 1 after its passage through the heating fixing area, the ink (pigment) forming its printed image has been fixed in the fixing layer 11. Hence, by removing the surface layer 12, a finished printed product 100 with clearly color-developed image is obtained. Incidentally, in this embodiment, the series of transportation of the recording medium is effected by means of the transport mechanism 6 which is illustrated as the roller type. Instead, other transport method such as of the belt-type may be employed.

The recording medium 1 is provided originally in the form of an elongate sheet from its manufacturer. Hence, it is necessary to cut it to a size of a printed image formed thereof. To this end, in this embodiment, there is provided a sheet cutter 5 attached to the inkjet head 2. As this sheet cutter has its cutter blade 51 attached to the inkjet head 2, the recording sheet 1 may be cut with the drive from the head feed mechanism 3.

The heater device 4 includes, inside a heating space 40A formed by a wall member 40 made of heat insulating material, an electric heater 41 for elevating air temperature inside this heating space 40A, a temperature sensor 42 for measuring temperature inside the heating space 40A, a fan 43 for feeding hot air heated by the electric heater 41, a fan motor 44 for driving the fan 43, and a shielding plate 45 for preventing the heat from the electric heater 41 from being directly irradiated onto the recording medium. By causing the recording medium 1 charged into this heating space 40A to come into contact with the air heated to a predetermined temperature, the recording medium is subjected to a non-contact heating, thus realizing sublimating fixation of the ink with this heating.

Further, inside this heating space 40A, there is provided a CCD camera 90 as an image pickup device for monitoring the fixing behavior of the ink on the recording medium 1. This CCD camera 90 has its focus set on the surface layer 12 of the recording medium 1 when it is fixed in position inside the heating space 40A, so that the camera shoots the change in which the density of the print dots (ink droplets) formed on the surface layer 12 is gradually reduced as the dots are sublimated into the fixing layer 11 during the heating sublimation process. And, as described below, the density values contained in this recorded image data will be utilized for sublimation degree evaluation effected by a sublimation degree evaluating section 91 incorporated within the fixing behavior evaluating means 9.

Incidentally, as a modified mode of arrangement of this CCD camera 90, in case the substrate 10 of the recording medium 1 is transparent or semi-transparent, the CCD camera 90 is disposed on the side of the substrate 10 of the recording medium 1 and has its focus on the fixing layer 11 so as to record the increasing density of the sublimated print dots gradually formed on the fixing layer 11 with progress of the heating sublimation process and the density values contained with such recorded image data may be used for the purpose of the sublimation degree evaluation.

In either case, when the sublimation degree calculated in the heating sublimation process has reached a predetermined level, the recording medium 1 is discharged from the heating space 40A, whereby the heating sublimation fixing on the recording medium 1 is completed. Needless to say, if the sublimation degree appropriately calculated in the heating sublimation process is found to be still lower than the target value, control operation may be effected for raising the temperature of the heating space 40A.

As a rule of thumb, with the sublimating type ink employed in this embodiment, its sublimation will take place smoothly at about 170 to 200° C., though this specific temperature may vary depending on the type of the recording medium 1 employed or the environment temperature. And, the appropriate sublimating fixation of the ink pigment to the fixing layer 12 will be realized with heating for about one minute in the case of 200° C. or for about five minutes in the case of 170° C.

The inkjet head 2, head feeding mechanism 3, heater device 4, sheet cutter 5, transport mechanism 6 and others are comprehensively controlled by a controller 7. A sheet detecting sensor 60 is provided at a predetermined position on the transport passage formed by the transport mechanism 6 in order to grasp the position of the recording medium 1 to be transported by the transport mechanism 6. And, a detection signal from this sensor 60 too is transmitted to the controller 7. Further, a recording medium type detecting sensor 61 is also provided for detecting an ID code provided on the roll sheet cartridge or a shaft member winding the recording medium 1 around it. And, this sensor 61 too transmits its detection signal to the controller 7, so that the controller 7 may recognize the characteristics of the charged recording medium 1 based on this detection signal.

This controller 7 of the image forming apparatus includes a first controller 7A provided in the operator's station OS and a second controller 7B provided in the printing station PS, with the two controllers 7A, 7B being connected to each other via communication cable for allowing data exchange therebetween, so that the two controllers 7A, 7B may function just like a single controller.

As shown in FIG. 2, the operator's station OS includes a general-purpose computer 80 acting also as the first controller 7A, a monitor 81, a keyboard 82, a mouse 83, a film scanner 85 for effecting photoelectric conversion of a photographic image of a developed photographic film F into color image data, and an image reading unit 84 (in this case, this unit is incorporated within the computer 80) for reading or obtaining color image data from a data storage medium (CD, CD-R, MO, or any kind of semiconductor memory device such as Compact-Flash or Smart-Media as well as any communication media comprising a data communication line). In the case of this image forming apparatus, the image data obtained by the film scanner 85 or the image reading unit 84 and then transmitted to the first controller 7A will be subjected to various data processing operations and then the processed image data will be transmitted as source print data to the second controller 7B, so that a printed image will be formed on the recording medium 1 at the printing station PS. In the course of this, the recording medium 1 is subjected to the heat sublimation fixing process within the heater device 4 based on the evaluation information outputted from the fixing behavior evaluating means 9.

As described above, the controller 7 includes the first controller 7A and the second controller 7B each having as a major component thereof a microcomputer system having CPU, ROM, RAM, I/O interface circuit etc., and the second controller 7B. As shown in FIG. 4, to the first controller 7A, via the I/O interface circuit, there are connected such peripheral devices as the image reading unit 84, the film scanner 85, etc. To the second controller 7B, via its I/O interface circuit, there are connected the peripheral devices incorporated in the printing station PS including the inkjet print head 2, the head feeding mechanism 3, the heater device 4, the CCD camera 90 used for the sublimation degree evaluation as fixing behavior evaluation and the transporting mechanism 6. The first controller 7A and the second controller 7B are capable of data transmission therebetween via the respective communication modules. For instance, the image data having been subjected to the image processing and adjustment processing at the first controller 7A will be converted into final print data, which will then be transmitted to the second controller 7B via the communication module 74*a*, 74*b* to be subsequently used for e.g. application of the sublimating ink to the recording medium 1.

The various functions provided by the controller 7 are realized by means of hardware and/or software. Referring here to only those functional elements having relevance to the present invention, the following sections are provided as typical examples; namely, a print size setting section 70 for setting a designated print image size through an operator's operation of the keyboard 82 or the mouse 83; an image processing section 72 for effecting resolution change or trimming on the image data transmitted from the image data inputting section 9 according to the print image size set at the print size setting section 70 and effecting also image adjustment processing such as color adjustment or head shading adjustment in cooperation with an image adjustment setting section 72*a*; a print data generating section 73 for generating source print data for subsequent use by the print head 2 from the image-processed image data by implementing a binarizing method such as an error diffusing method; a print controlling section 75 for driving the print head 2 in accordance with the transmitted print data for discharging ink droplets through the outlet; a head feed controlling section 76 for moving the print head 2 along the main scanning direction in synchronism with driving of the print head 2; a transportation controlling section 77 for controlling the intermittent feeding of the recording medium 1 in synchronism with the movement of the print head 2 along the main scanning direction and effecting transportation of the recording medium 1 to and form the heater device 4; a heating controlling section 78 for controlling the driving of the electric heater 41 and the fan motor 44 of the heater device 4; a fixing behavior evaluating means 9 for providing a heating control amount to this heating controlling section 78 with taking into consideration the fixing behavior of the ink; and a recording medium type identifying section 79 for obtaining type data of the charged recording medium 1 based on the ID code thereof read by the recording medium type detecting sensor 61.

In this embodiment, the fixing behavior evaluating means 9 includes a sublimation degree calculating section 91 for reading the density of the print dots under their sublimation based on the photographed image data transmitted from the CCD camera 90 and calculating the sublimation degree from this density value. The heating controlling section 78 and the transportation controlling section 77 are associated with the sublimation degree calculating section 91. Hence, the heating controlling section 78 will adjust the target heating temperature in case the sublimation degree calculated by the sublimation degree calculating section 91 in the course of the heating sublimation fixing process is displaced from a predetermined level and the transportation controlling section 77 will discharge the recording medium 1 from the heater device 4 when the sublimation degree calculated by the sublimation degree calculating section 91 has reached the appropriate level.

Figure 5:
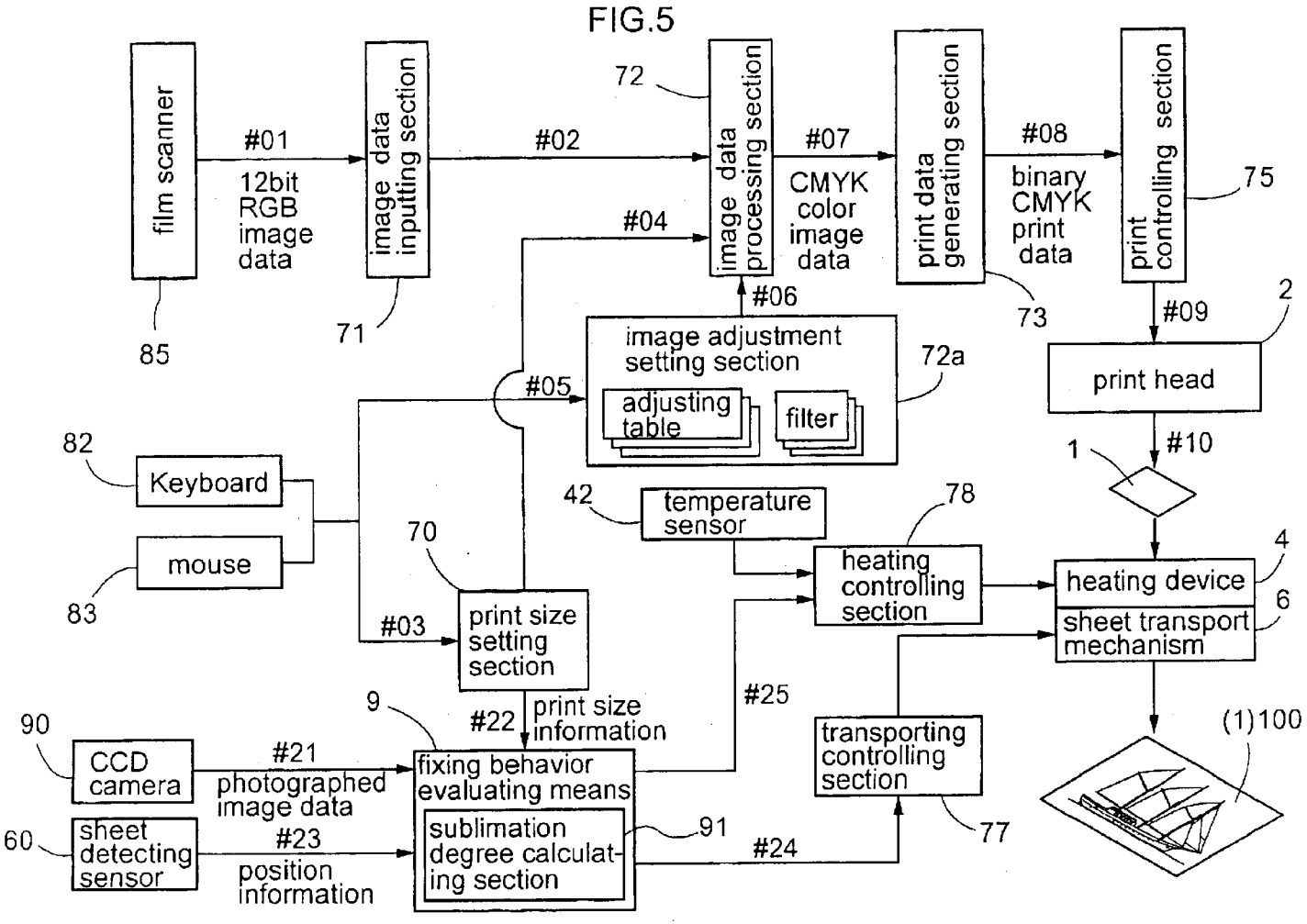
FIG. 5 is a schematic flowchart illustrating a process in which a final printed product is obtained by heating a recording medium having an image formed by an inkjet head driven according to image data inputted thereto.

Next, with reference to the schematic flowchart of FIG. 5, there will be described a process until a photographic image is formed on the recording medium 1 with using color image data of a photographic image read from a color negative film F by using the film scanner 85.

When the film scanner 85 has read the color negative film F, output signals from CCD of this film scanner 85 are amplified and then A/D converted into 12-bit RGB color image data, which are then transmitted to the image data inputting section 71 (#01). After subjecting to typical adjustment as scanner data such as gamma control at the image data inputting section 71, the data are transmitted to the image processing section 72 (#02). Before or after this process, the operator operates the keyboard 82 and/or the mouse 83 while reading a print order slip from the customer to input a designated print image size and this print image size is set to the print size setting section 70 (#03).

The image processing section 72 first effects a resolution conversion and/or trimming, if needed, on the received color image data, corresponding to the finished print size, based on the print image size received from the print size setting section 70 (#04). Further, the processing such as color adjustment commonly effected in a digital photographic printing will be effected automatically or manually by the operator's operation on the keyboard 82 or the mouse 83 (#05). For such adjustments, an adjustment table or a filter suited for each adjustment will be loaded by the image adjusting setting section 72*a* to the image processing section 72 (#06).

At the image processing section 72, the color image data having undergone all the image processing is transmitted to the print data generating section 73 (#07). Incidentally, since the RGB color data have already been converted into the CMYK color image data at an appropriate stage after or before the other image processing at the image processing section 72, the color data transmitted to the print data generating section 73 are CMYK color image data.

Then, the print data generating section 73 effects a binarizing processing on the received 8-bit CMYK color image data to form gradation for the area gradation by the print head 2, thereby to generate binary CMYK print data and transmits this to the print controlling section 75 (#08).

The print controlling section 75 produces, from the received binary CMYK print data, driving pulse signals for the print head 2 (#09) and controls the driving elements of the print head 2 with these pulses for jetting ink droplets against the recording medium 1. At the same time, the head feed controlling section 75 controllably drives the head feed mechanism 3 and the transport controlling mechanism 77 controllably drives the transportation mechanism 6, whereby a photographic image is gradually formed on the recording medium 1 (#10).

Regarding the sublimation degree calculating section 91 provided in the fixing behavior evaluating means 9, its heating control for the recording medium 1 will be described with reference also to the schematic view of FIG. 6. The density values of the pixels corresponding to the image areas to be considered, determined with taking into consideration the print size information from the print size setting section 70 (#22) and/or the position information of the recording medium 1 from the sheet detecting sensor 60 (#23) are calculated by using the photographed image data transmitted from the CCD camera 90 (#21).

Figure 6:
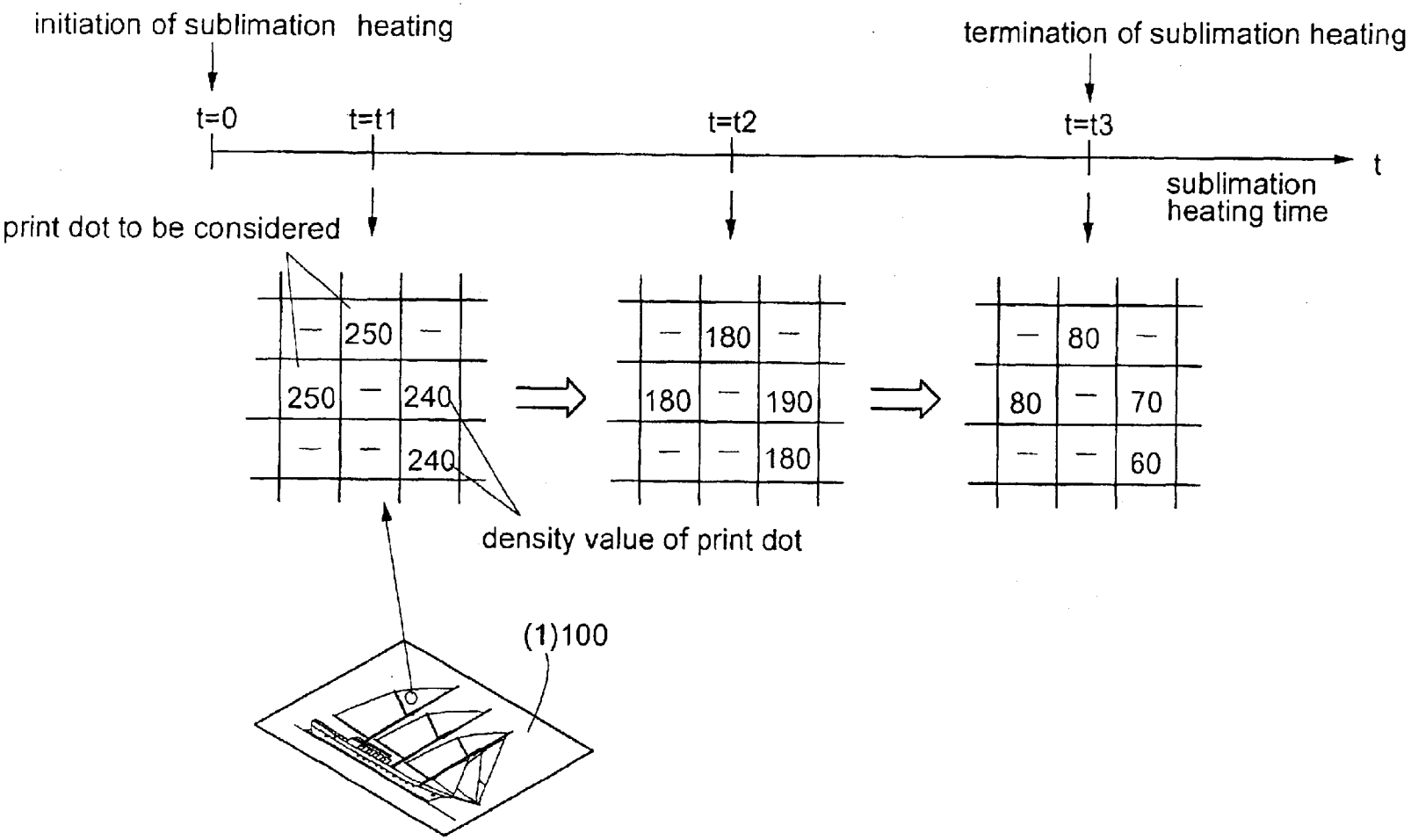
FIG. 6 is an explanatory view illustrating a process for obtaining density values of pixels corresponding to an image area to be addressed.

FIG. 6 schematically illustrates change in the density values of the pixels i.e. the sublimation degrees, with progress of the heating process. Each cell shown represents a pixel corresponding in one-to-one relationship to a print dot and the numeric value in each cell is the density value of the print dot whose sublimation degree is to be calculated. The measurement of these density values is effected by a predetermined interval upon initiation of the sublimation heating by the heater device 4. As this embodiment employs the method of calculating the sublimation degree based on the degree of reduction in the density of the print dot (ink droplet) formed on the surface layer 12 as the dot is sublimated and transferred to the fixing layer 11 in the heating sublimating process, each obtained print dot has a value near the maximum value (the value of "255" in the 8-bit density data format) at the time of initiation of the sublimating heating (lapsed heating time: t=t1). And, with progress of the heating period, the sublimation of the print dot (un-sublimated print dot) formed on the surface layer 12 advances, the density value of the print dot calculated by the sublimation degree calculating section 91 constituting the sublimation degree evaluating means 9 is reduced with the lapse of the period. When the reducing the density value has reached a predetermined level (e.g. a density value of 100 or less), this is interpreted that the ink applied to the surface layer 12 has been sufficiently sublimated and transferred onto the fixing layer 11, so that the sublimating heating process is finished. And, the sublimation degree calculating section 91 instructs the transportation controlling section 77 to discharge the recording medium 1 from the heater device 4 (#24) and also instructs the heating controlling section 78 to stop the heating operation of the heater device 4 unless heating sublimation fixing process is to be effected in succession (#25). Further, if the decreasing rate of the density value is found lower than the predetermined level in the course of the heating sublimation fixing process, the section 91 interprets this as occurrence of delay in the sublimation and thus instructs the heating controlling section 78 to raise the target heating temperature.

In summary, according to the feature of the above-described embodiment, the recording medium 1 is placed within the heating space 40A created inside the heater device 4 and the medium 1 is heated under this condition. During this, while the degree of the sublimation fixing of the un-sublimated print dots formed on the surface layer 12 onto the fixing layer 1, i.e. the sublimation degree, is monitored by means of the CCD camera 90 disposed inside the heater device 4 and the sublimation degree calculating section 91 incorporated in the second controller 7B, the sublimating heating process is stopped upon achievement of the optimal sublimation degree. With this, an optimal heating processing can be realized.

[Modified Embodiment Constructions]

Figure 7:
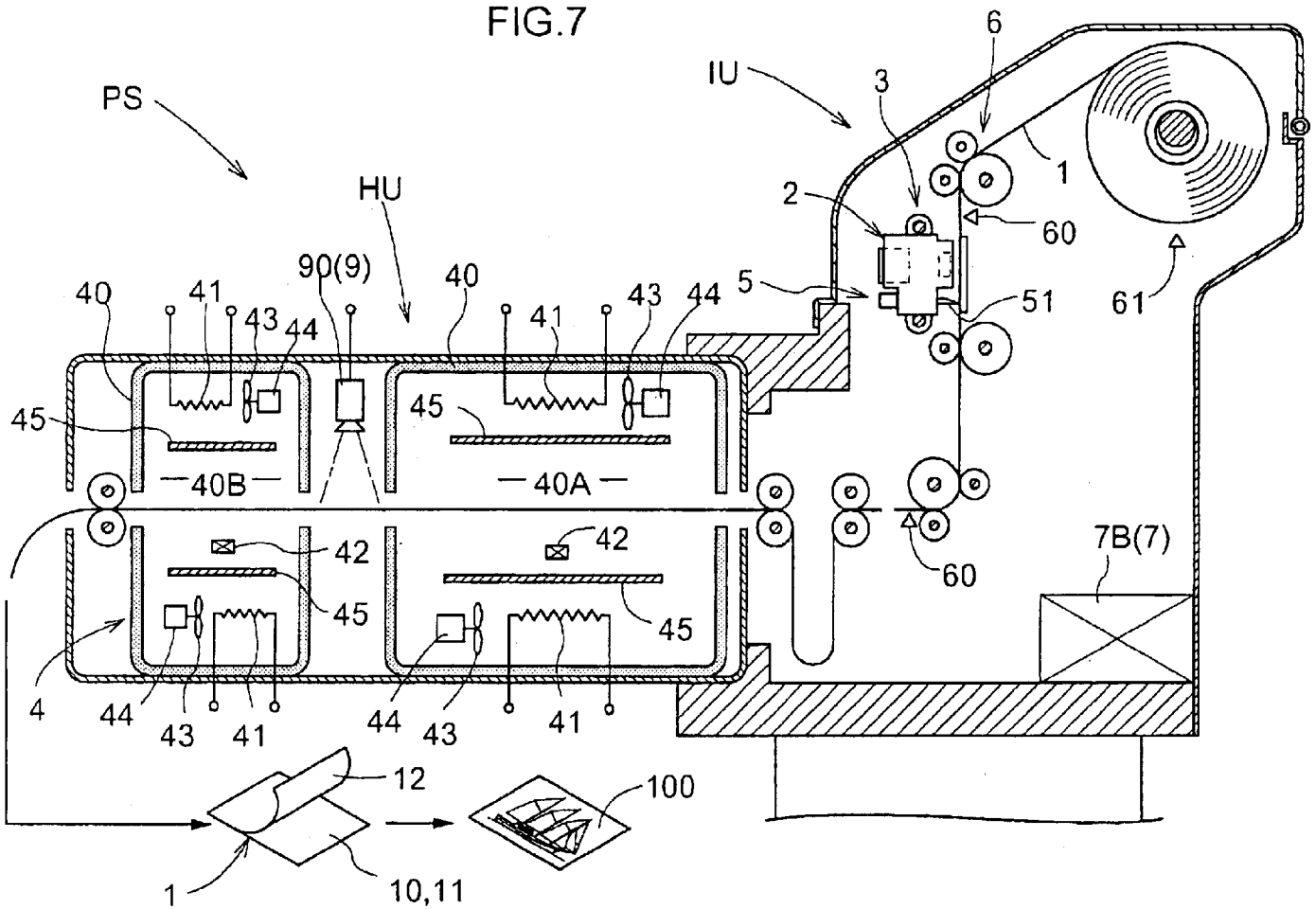
FIG. 7 is a schematic view illustrating a heat sublimating fixing process to be effected by the invention's image forming apparatus based on sublimation degree evaluation relating to a further embodiment.

(1) In the case of a modified construction shown in FIG. 7, the heater device 4 forms therein a main heating space 40A and an adjusting heating space 40B. The adjusting heating space 40B is disposed downstream of the main heating space 40A relative to the transporting direction of the recording medium 1 and also has a much shorter width than the main heating space 40A in the transporting direction. The main heating space 40A and the adjusting heating space 40B each includes an electric heater 41, a temperature sensor 42 and a fan 43. And, between these spaces, i.e. the main heating space 40A and the adjusting heating space 40B, there is provided the CCD camera 90 constituting the sublimation degree evaluating means 9. While the main heating space 40*a* has a heating capability for realizing substantially complete heated sublimation of the recording medium 1 transported thereto, the adjusting heating space 40B has only a limited heating capability just enough to make up for small shortage in the heating sublimation fixing process which has taken place in the main heating space 40A. That is to say, in this modified embodiment construction, the sublimation degree of the recording medium 1 which has passed the main heating space 40A is evaluated by means of the CCD camera 90 and the sublimation degree calculating section 91 and only the shortage in the heating sublimation is made up, i.e. supplemented by its subsequent passage through the adjusting heating section 40B. Therefore, the heating temperature at the adjusting heating space 40B is adjusted according to the evaluated sublimation degree. The important feature of this modified embodiment construction is that the construction allows an optimal heating process to be effected on the recording medium 1 which is being transported continuously, without having to retain the medium 1 temporarily still inside the heater device 4.

Figure 8A:
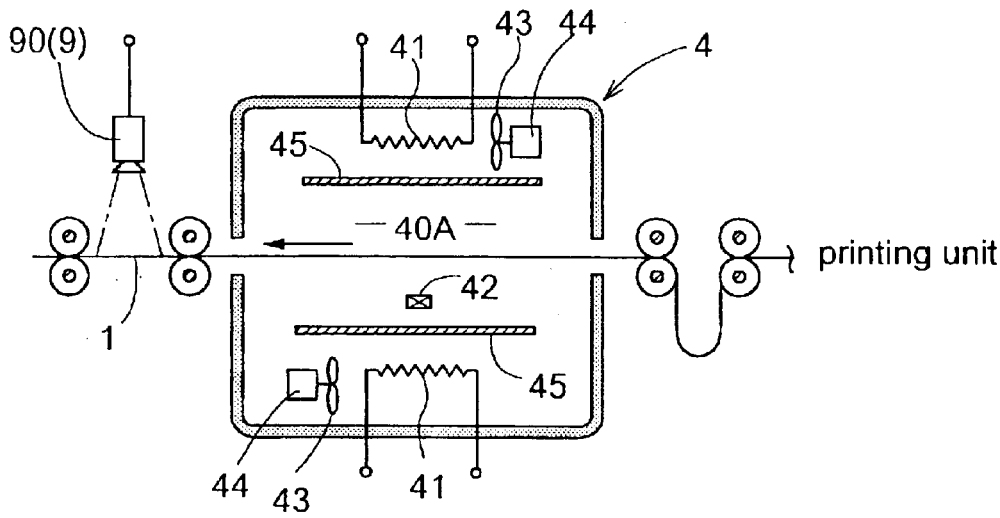
FIG. 8 is a schematic view illustrating a heat sublimating fixing process to be effected by the invention's image forming apparatus based on sublimation degree evaluation relating to a still further embodiment.
Figure 8B:
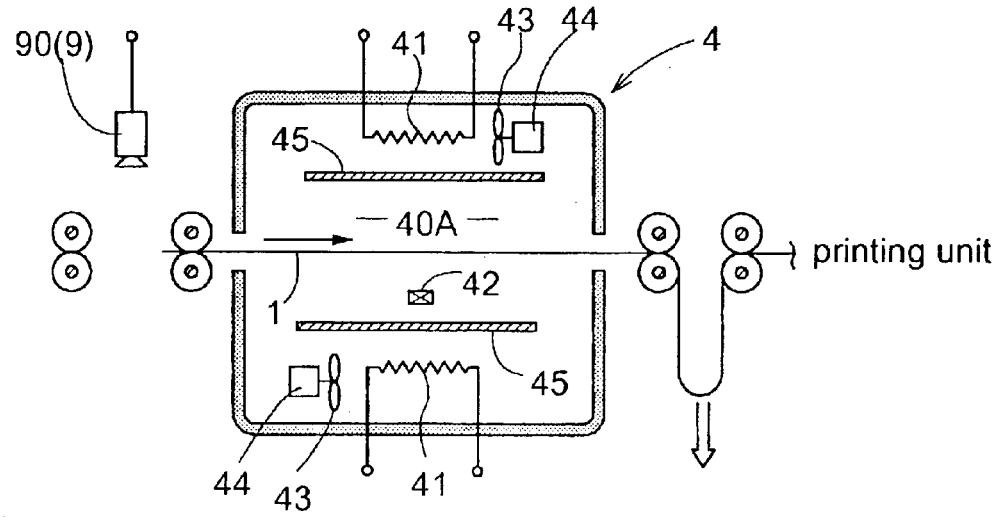
Figure 9A:
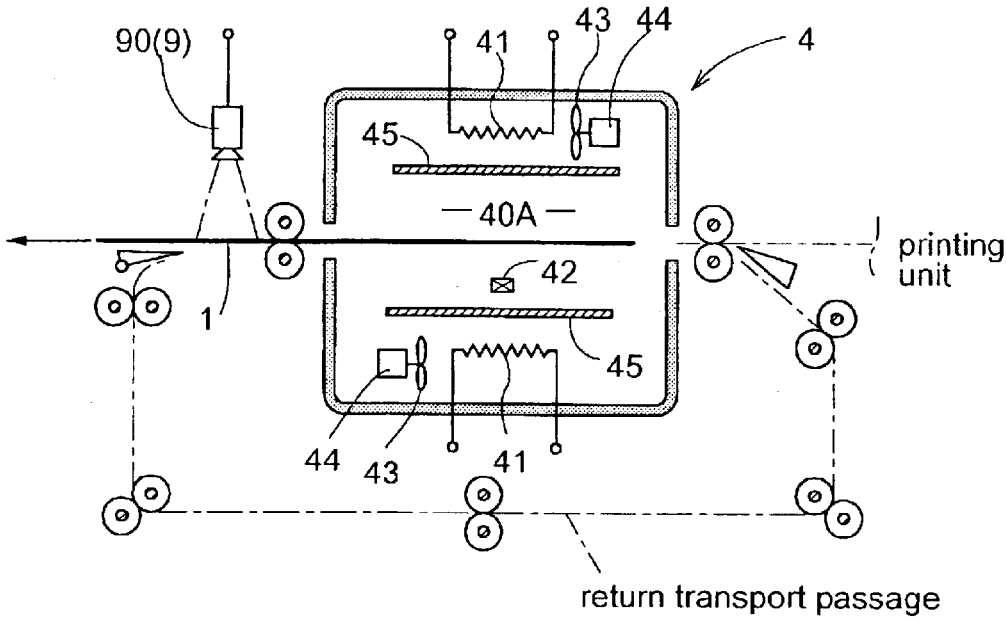
FIG. 9 is a schematic view illustrating a heat sublimating fixing process to be effected by the invention's image forming apparatus based on sublimation degree evaluation relating to a still further embodiment.
Figure 9B:
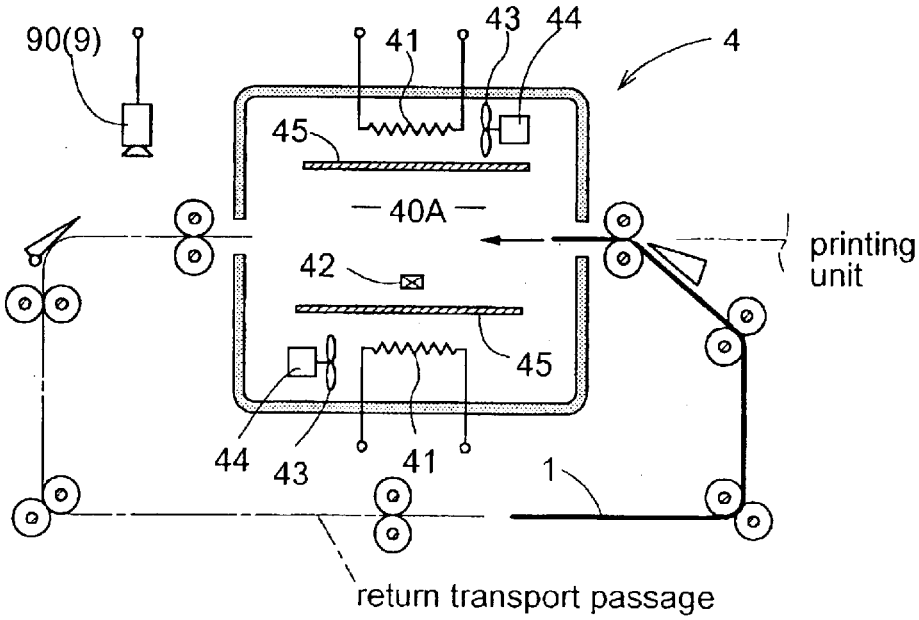

(2) Further modified embodiment constructions shown respectively in FIGS. 8 and 9 can also eliminate the necessity of retaining the recording medium 1 still inside the heater device 4 and can allow the optimal heating sublimating fixating process to be effected on the recording medium 1 being continuously transported. Compared with the modified construction of FIG. 7, these further constructions of FIGS. 8 and 9 are distinct in that a single heating space 40A is adapted to act both as a main heating space and an adjusting heating space. After undergone the heating sublimating fixing process at the heating space 40A, the recording medium 1 has its sublimation degree checked by the CCD camera 90 located at the exit side of the heating space 40A. And, based on the heating temperature or heating period set based on the sublimation degree calculated by the sublimation degree calculating section 91, this recording medium 1 is subjected again to the heating sublimating fixing process at the same hating space 40A. In this, in the case of the modified construction shown in FIG. 8, after the recording medium 1 has once exited the heating space 40A (FIG. 8(*a*)) and then has its sublimation degree checked by the CCD camera 90, this recording medium 1 is reversed to enter the heating space 40A this time (FIG. (*b*)) from the rear end of the medium to be heated therein again. Whereas, in the case of the modified construction of FIG. 9, after the recording medium 1 has once exited the heating space 40A (FIG. 9(*a*)) and then has its sublimation degree checked by the CCD camera 90, this recording medium 1 is branched to a return transport passage (a transport passage bypassing the heating space 40A) to enter again the heating space 40A form the leading end of the medium 1 (FIG. 9(*b*)) to be heated therein again.

Figure 10:
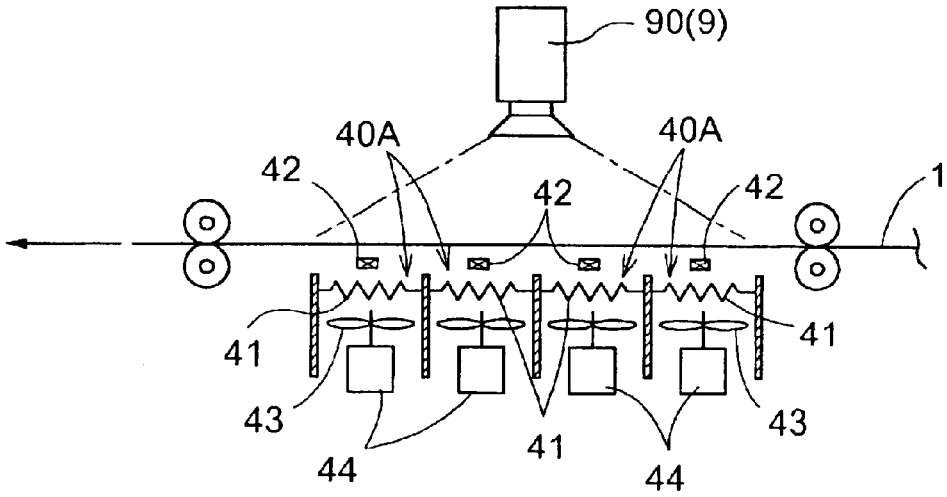
FIG. 10 is a schematic view illustrating a heat sublimating fixing process to be effected by the invention's image forming apparatus based on sublimation degree evaluation relating to a still further embodiment.

(3) In a still further modified embodiment construction shown in FIG. 10, the heating space consists of a plurality of separate heating spaces 40A. Each heating space 40A includes an independently controllable electric heater 41, a temperature sensor 42 and also a fan 43, when needed, so that the sublimation degree evaluating means 9 evaluates the sublimation degree for each of sublimation-degree calculating areas provided in correspondence to the separate sections of the heating space 40A. That is to say, according to this modified construction, the heating sublimation fixing process is effected for each of the plurality of separate areas and the sublimation degree evaluation too is effected for each area so that the heating behavior is adjusted independently for each of the heating spaces 40A so as to obtain the optimal sublimation degree in each area. With this construction, it is possible to compensate for sublimation degree variation in the two-dimensional plane of the recording medium 1 which may occur in some cases.

Figure 11A:
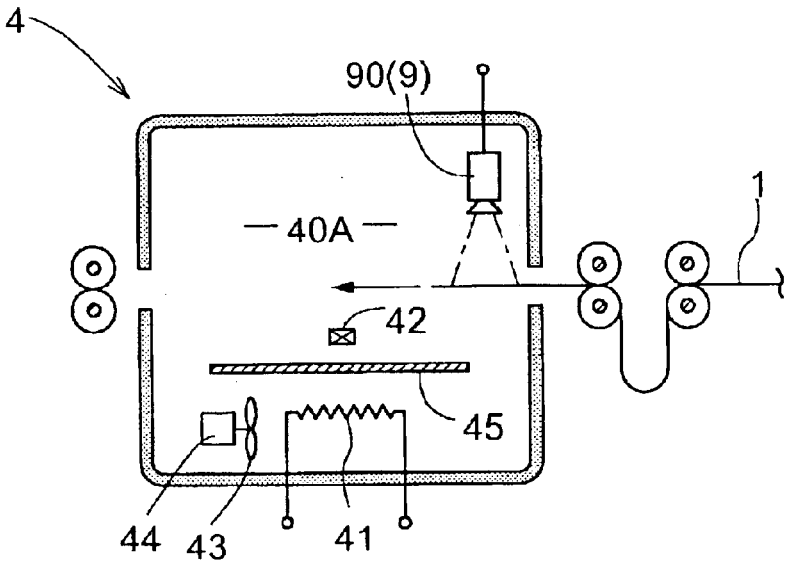
FIG. 11 is a schematic view illustrating a heat sublimating fixing process to be effected by the invention's image forming apparatus based on sublimation degree evaluation relating to a still further embodiment.
Figure 11B:
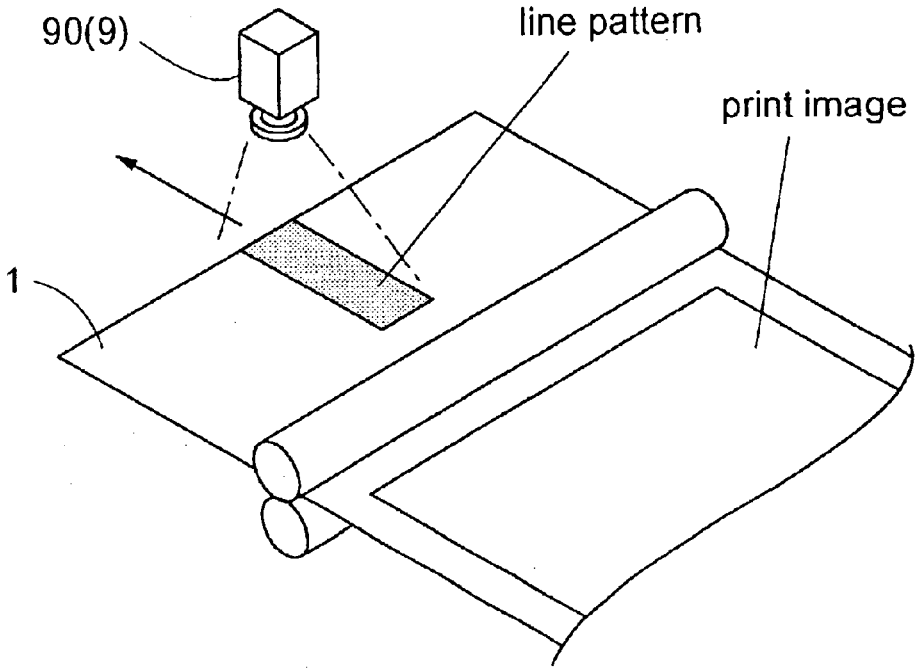

(4) FIG. 11 illustrates a method for evaluating the fixing behavior (sublimation degree change) with using a test pattern. In this case, un-sublimated print dots or resultant sublimated print dots for use in this sublimation degree evaluation are not to constitute an actual print image to be obtained, but to constitute a predetermined test pattern (i.e. a pattern of lines arranged adjacent the print image). In this case, as the CCD camera 90 can have its focus aligned with the line pattern whose position from each edge of the recording medium 1 is predetermined, the position detecting algorithm for the print dots may be simple. Moreover, this test pattern may be formed on a further recording medium 1 provided separately from the recording medium 1 on which a print image has been actually formed. This provides possibility of effecting the heating control by sublimation degree evaluation not in real time, but in off-line manner. That is to say, this construction can omit the heating control based on the real time sublimation degree evaluation for each print which is executed by the heating controlling section 78 through controlling the target heating behavior e.g. the heating period or heating temperature, of the heater device 4 with reference to the control amount outputted based on the sublimation degree obtained by the sublimation degree calculating section 91 from the recording medium 1 having the test pattern heated and fixed in the preceding predetermined heating process.

[Other Embodiments]

Figure 12:
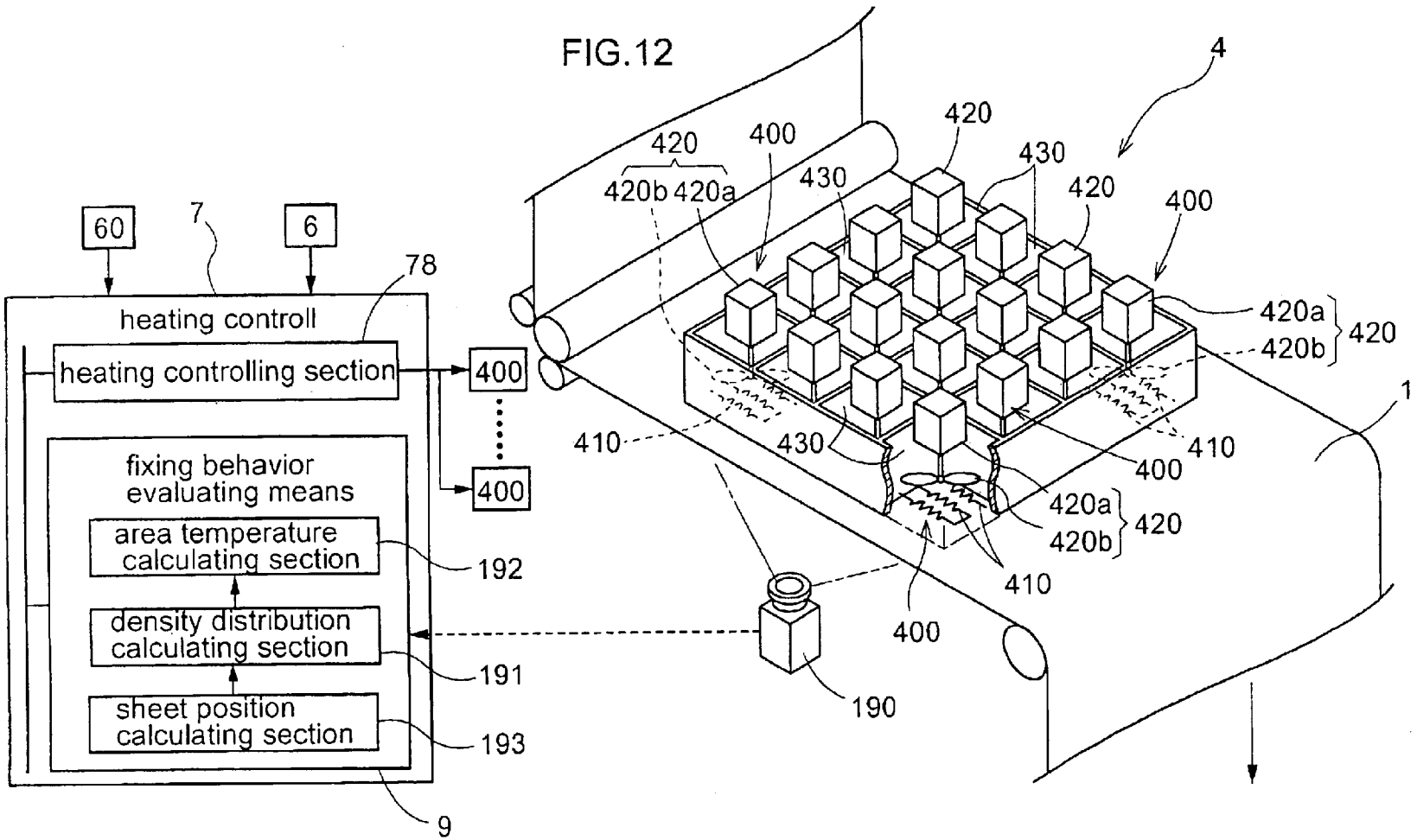
FIG. 12 is a schematic view illustrating a heater device and a heating control relating to the second embodiment of the invention.

(1) FIG. 12 shows an image forming apparatus according to the second embodiment of the present invention. In this second embodiment, the heater device 4 includes a plurality of heating sub-units 400 arranged in the form of a matrix. Also, the fixing behavior evaluating means 9 has a function for evaluating surface temperature distribution of the recording medium 1 obtained by an infrared camera 140 acting as a temperature sensor means for determining the surface temperature distribution of the recording medium 1, so that a control amount is provided to the heating controlling section 78 so as to maintain the evaluated surface temperature distribution at a predetermined temperature distribution.

As may be apparent from FIG. 12, this heater device 4 includes 4×4 (16 units) of the heating sub-units 400 each having an electric heater wire 41 as a heater element and a blower fan 42, with the sub-units being arranged in the form of matrix in a plane parallel to the transporting plane of the recording medium 1. Therefore, with this heater device 4, it is possible to heat, as desired, each area of the recording medium passing its heating area corresponding to the matrix of the sub-units 400.

The infrared camera 190 is adapted to be capable of photographing the entire print image formed on the recording medium 1. So that, based on the obtained photographic image, the surface temperature distribution may be obtained for the respective unit areas of the recording area 1 defined in correspondence to the arranging matrix of the heating sub-units 400 and to control each heating sub-unit 400 based thereon. With this, even if the surface temperature distribution is changed due to a certain factor in the course of the heating process of the recording medium 1 which is passing the heating fixing area, such varied surface temperature distribution may be returned to the uniform condition as much as possible in the course of this heating process.

In order to avoid thermal influence from the other heating sub-units 400 and also to allow much of generated heat flow to reach the surface of the recording medium 1, each heating sub-unit 400 includes a partition wall 430, which is formed as a square tube in this particular embodiment. Inside this partition wall 430 and an upper region thereof, there is mounted a blower fan 420 and at a lower region thereof, there is mounted an electric heater wire 410. The blower fan 420 consists of a motor 420*a* controlled by the heating controlling section 78 and a blower fan blade 420*b* fixed to a rotary shaft of this motor 420*a*. If necessary, a variable motor is employed as the motor 420*a*.

When the electric heater wire 41 of a certain heating sub-unit 400 is driven to its maximum and the blower fan 41 is rotated, a local area in the recording medium 1 opposed to this particular heating sub-unit 400 is to be heated intensively. Conversely, when the power to the electric heater wire 41 is stopped and the blower fan 41 is rotated, the local area of the recording medium 1 opposed to this heating sub-unit 400 will be weakly heated or cooled. Namely, with this heater device 4, it is possible to heat a certain particular area of the recording medium 1 being passed more intensively or less intensively than the other areas thereof. As a result, it is possible to solve any deviation in the surface temperature distribution of the recording medium 1 which may occur in the course of the heating process in some cases.

For controlling each heating sub-unit 400, speedy and accurate determination of the surface temperature distribution of the recording medium 1 passing through the heater device 4 is necessary. For this reason, this embodiment employs the thermograph technique, in which an infrared camera 190 capable of covering the entire transportation area of the heater device 4 is employed and a temperature value of a local area of the recording medium 1 is calculated based on a density distribution image dependent on the surface temperature obtained as its photographed image. As the thermograph technique per se is well-known, further description thereof will be omitted here. Briefly, however, when the photographed image obtained by the infrared camera 190 is transmitted to the fixing behavior evaluating means 9 of the controller 7; first, based on color distribution of the areas divided in the form of predetermined matrix, the temperature values represented by the areas are calculated, thereby to produce a temperature distribution matrix of the represented temperature values. In this case, the size of this matrix is caused to agree with the size of the disposing matrix of the heating sub-units 400. Hence, if in this temperature distribution matrix any value is found which deviates from a predetermined temperature level, then, the controller 7 controls a particular heating sub-unit 400 opposing to a particular area on the recording medium 1 corresponding to that value, so as to maintain the surface temperature of this particular area within the predetermined temperature level.

To this end, the fixing behavior evaluating means 9 of this second embodiment includes a sheet position calculating section 193 for calculating the position of the recording medium 1 based on a detection signal of the recording medium 1 from a sheet detecting sensor 60 and a transportation speed of the recording medium 1 by the transporting mechanism 6, a density distribution calculating section 191 for processing photographed image signals transmitted from the infrared camera 190 and obtaining a density distribution dependent on their temperatures and an area temperature calculating section 192 for calculating the surface temperature representing each of the areas divided in the recording medium 1 based on the density distribution calculated by this density distribution calculating section 191.

Figure 13:
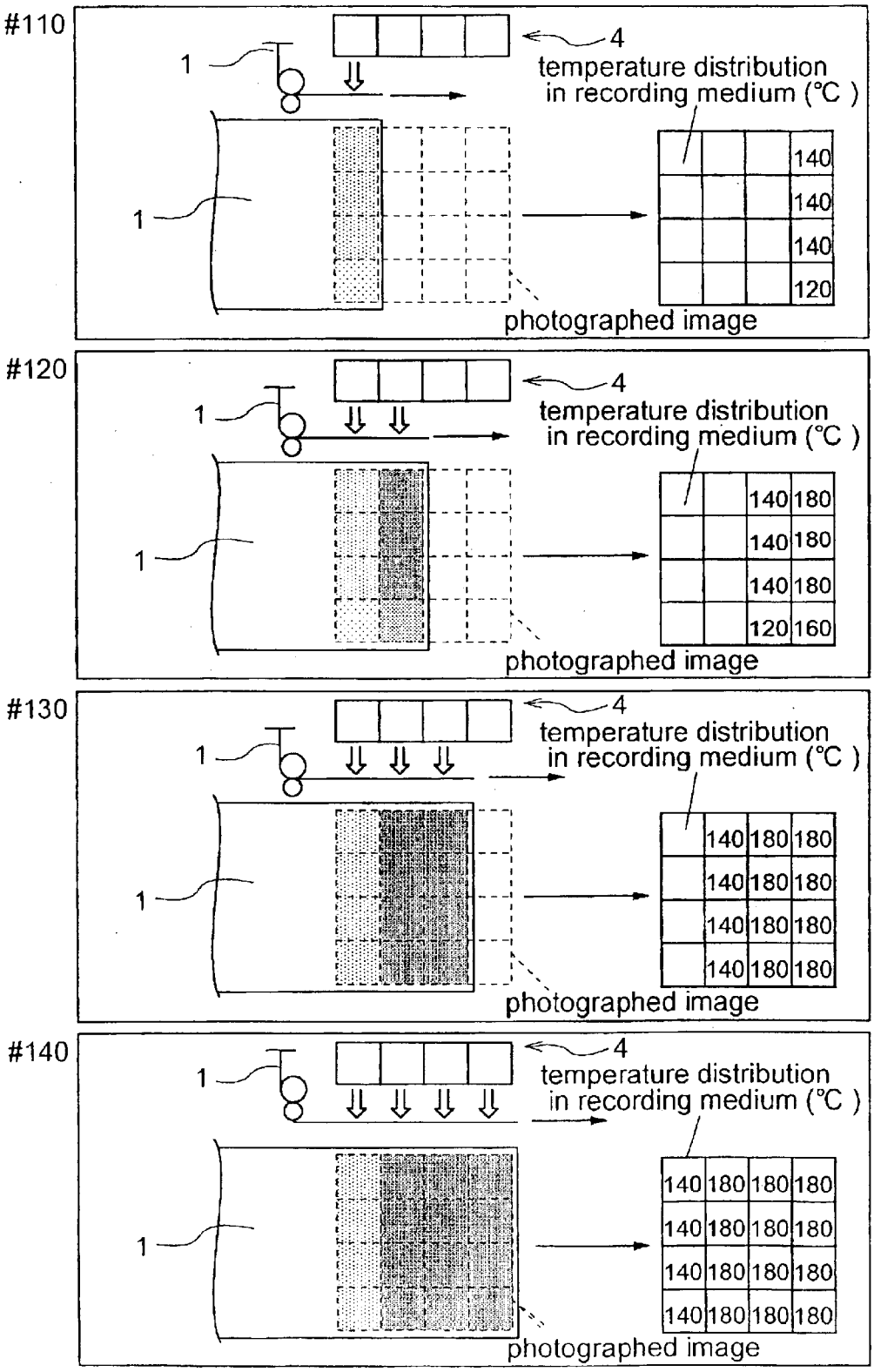
FIG. 13 is a schematic flowchart illustrating a process in which the recording medium is heated by the heater device of the second embodiment in such a manner that its surface temperature distribution may be uniform.

Next, with reference to a schematic flowchart of FIG. 13, there will be described a process in which the recording medium 1 having a print image formed thereon is heated in such a manner as to obtain a uniform surface temperature distribution by the infrared camera 190, the heater device 4, the fixing behavior evaluating means 9 and the heating controlling section 78 of the controller 7.

First, at step #110, the sheet detecting sensor 60 detects that a recording medium 1 having an ink printed image formed on its surface layer 12 by means of the inkjet head 2 has been charged into the area of the heater device 4. At this stage, the electric heater wires 410 and the blower fans 420 of the respective heating sub-units 400 of the heater device 4 are being driven at a standard setting level so as to supply heat toward the transportation line. The infrared camera 190 scans the areas divided in correspondence with the matrix arrangement of the heating sub-units 400 and transmits their photographed image signals to the controller 7. Then, based on the position information of the recording medium 1 under transportation obtained by the sheet position calculating section 193 and on the photographed image signals from the infrared camera 190, the density distribution calculating section 191 designates the surface areas of the recording medium 1 divided within the virtually constructed 4×4 matrix plane and calculates the densities (brightness values) of the respective surface areas of the recording medium 1. Subsequently, by utilizing this density distribution and a density/temperature conversion table preset therein, the area temperature calculating section 192 determines the surface temperature of each surface area of the recording medium 1 which is being heated and transported.

At step #120, there is shown a condition in which the recording medium 1 has advanced into the heating fixing area. By the method described above, the surface temperature of each surface area of the recording medium 1 under heating and transportation is obtained. In this particular example, most of the leading end are of the recording medium 1 has a temperature of about 180° C. and it is expected that the following area too will soon reach the temperature of about 180° C. also. However, as the right-side edge area relative to the transporting direction tends to have temperatures lower than the other areas, the controller 7 will adjust the electric heater wire 410 and/or the blower fan 420 of the corresponding heating sub-unit 400 to supply a greater heat to this particular area.

At step #130, the recording medium 1 has now advanced further into the heating fixing area, where the heating fixing process is to proceed on the area of the recording medium 1 where the print image is formed. In the course of this, with the effect of the individual feedback control of the heating sub-units 400, the surface temperature distribution of the recording medium 1 will be rendered uniform.

At step #140, as described hereinbefore, as the electric heater wire 410 and/or the blower fan 42 of each heating sub-unit 400 is feedback controlled, the surface temperature of each surface area of the recording medium 1 will be maintained at a uniform value with progress of the heating fixing process. In the case of the recording medium 1 employed in this embodiment, the temperature suitable for sublimation and fixation of the ink applied to its surface layer 12 onto its fixing layer is about 180° C. Therefore, it will be understood that the control is effected so that the temperatures of all the areas may be maintained at about 180° C. However, in a special case, such as a case of partially using a special type of ink or using a special type of material, it will also be possible to effect the control in such a manner that the surface temperature of a particular area may be maintained at a temperature different from the other areas.

In these ways, heating will be effected such that the surface temperature distribution of the entire surface of the recording medium 1 bearing the print image formed on the surface layer 12 will be uniform eventually, whereby occurrence of wrinkles or undulations due to local temperature displacement may be restricted very effectively. Moreover, since the optimal temperature required for the sublimation fixation of the ink to the fixing layer can be maintained with high precision in all the areas, there is achieved another advantage of improvement in the color development and image clearness of the image to be obtained on the final printed product 100.

In the foregoing, the surface temperature distribution preset in the heating fixation of the recording medium 1 having a printed image formed thereon is maintained at a single temperature value. Instead, it is also possible to maintain it to a temperature value which varies with lapse of the heating period or to a plurality of time-changing temperature values such as 80° C. for the initial heating stage, 180° C. for the intermediate heating stage and 80° C. again for the final heating stage. Further alternatively, the distribution may be set such that only a particular area of the recording medium 1 may be maintained at a different temperature than the other areas thereof.

Further, in the foregoing, the temperature sensor means comprises a device capable of determining the surface temperature of the entire areas of the recording medium 1. Instead, this sensor means may comprise a plurality of determining devices each capable of determining a surface temperature of a limited area assigned thereto in correspondence with each of the heating sub-units 400 which are disposed in the matrix arrangement pattern.

Figure 14:
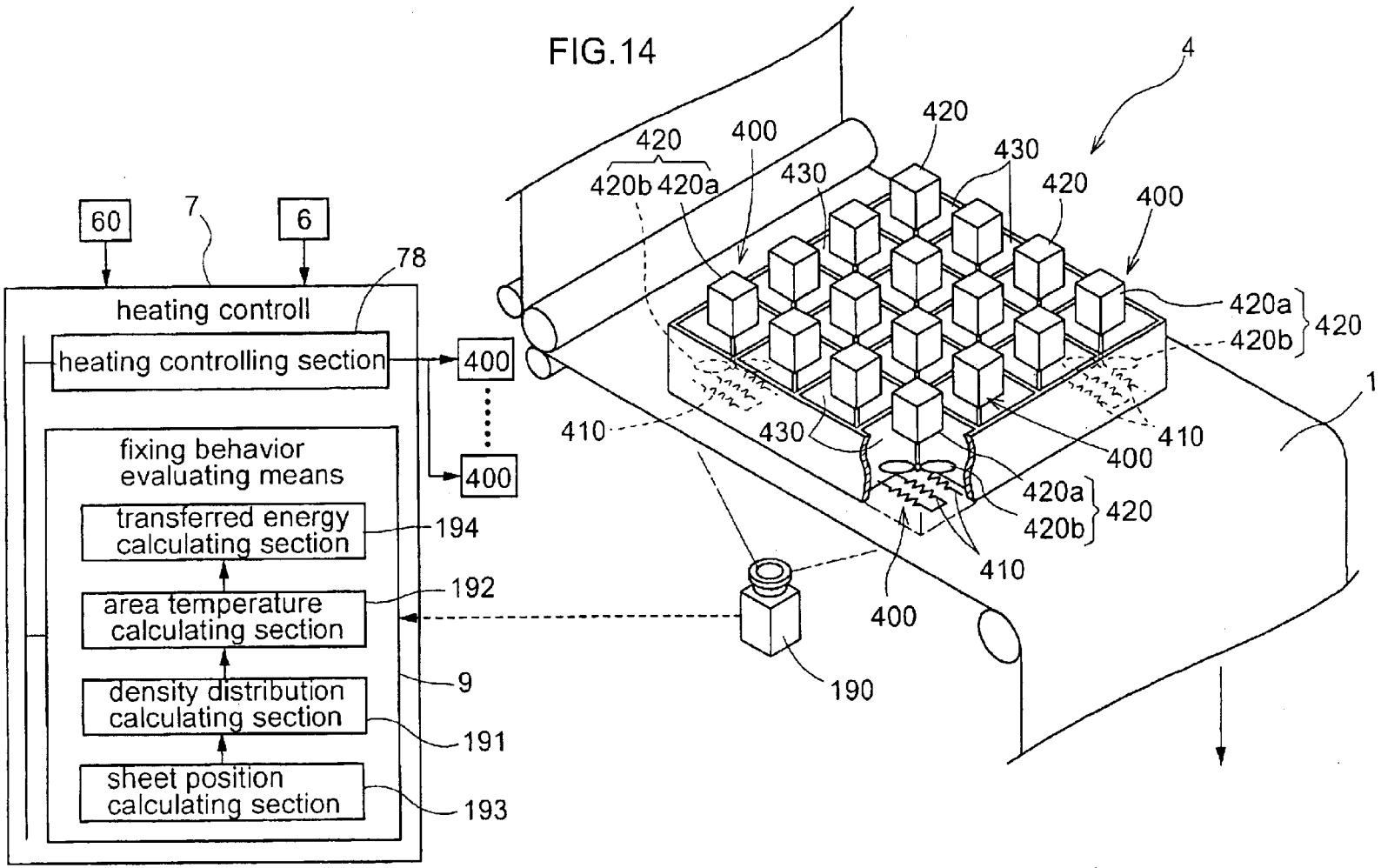
FIG. 14 is a schematic view illustrating a heater device and a heating control relating to the third embodiment of the invention.

(2) FIG. 14 shows an image forming apparatus relating to the third embodiment of the present invention. In this third embodiment, like the second embodiment described above, the heater device 4 comprises a plurality of heating sub-units 400 arranged in a matrix pattern. Further, the fixing behavior evaluating means 9 includes a transferred thermal energy evaluating function for evaluating energy delivered from or received by each area of the recording medium 1 by effecting a time-base multiplication of the surface temperatures obtained by the infrared camera 190 as the temperature sensor means for determining the surface temperature distribution of the recording medium 1 and the control amount to be provided to the heating controlling section 78 is adjusted such that the evaluated transferred thermal energy may be maintained at a predetermined value.

Specifically, when the photographed image obtained by the infrared camera 190 is transmitted to the fixing behavior evaluating means 9 of the controller 7; first, based on color distribution of the areas divided in the form of predetermined matrix, the temperature values represented by the areas are calculated, thereby to produce a temperature distribution matrix of the represented temperature values. In this case, the size of this matrix is caused to agree with the size of the disposing matrix (m×n) of the heating sub-units 400. Further, based on the each value of the temperature distribution matrix and the position information of the recording medium 1 being transported, the surface temperature of each area defined on the recording medium 1 may be obtained. Then, by multiplying this surface temperature with a sampling interval for the surface temperature determination: Δt, transferred thermal energy may be calculated. And, the transferred thermal energy of each area calculated with each sampling cycle will be added. The calculation of transferred thermal energy with time-base multiplication is effected by the fixing behavior evaluating means 9.

To this end, the fixing behavior evaluating means 9 of this third embodiment includes a sheet position calculating section 193 for calculating the position of the recording medium 1 based on a detection signal of the recording medium 1 from a sheet detecting sensor 60 and a transportation speed of the recording medium 1 by the transporting mechanism 6, a density distribution calculating section 191 for processing photographed image signals transmitted from the infrared camera 190 and obtaining a density distribution dependent on their temperatures, an area temperature calculating section 192 for calculating the surface temperature representing each of the areas divided in the recording medium 1 based on the density distribution calculated by this density distribution calculating section 191, and a transferred energy calculating section 194 for obtaining the thermal energy received by each area by the time-base multiplication of the temperature of each area of the recording medium 1 (e.g. a product of multiplication of a calculated temperature with the predetermined interval will be added one after another).

Next, with reference to a schematic flowchart of FIGS. 15 through 19, there will be described a process in which the recording medium 1 having a print image formed thereon is heated in such a manner that the total thermal energy received by the respective areas of the recording medium 1 having a printed image formed already thereon may be a predetermined value by the infrared camera 190, the heater device 4, the fixing behavior evaluating means 9 and the heating controlling section 78 of the controller 7.

Figure 15:
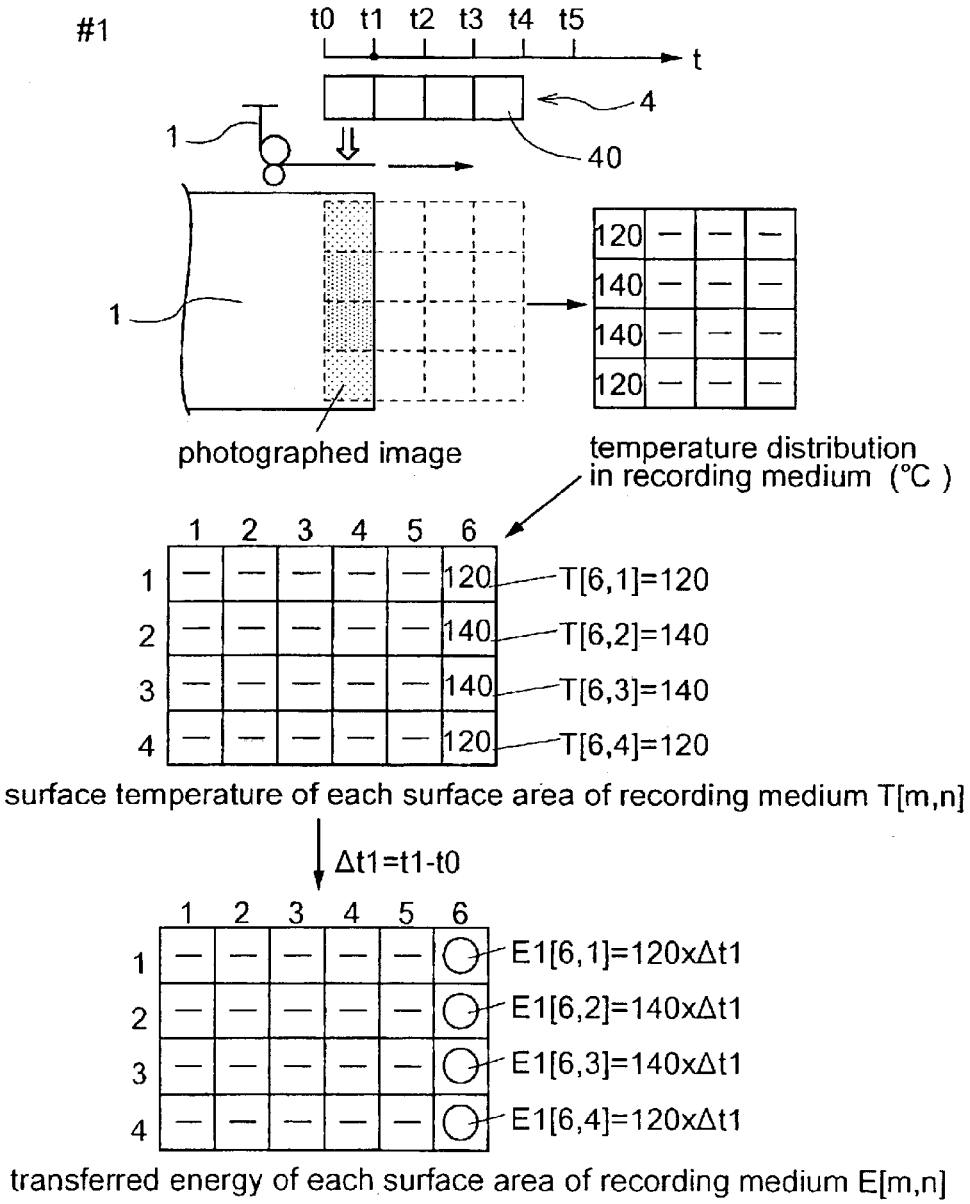
FIG. 15 is a schematic flowchart illustrating a first step of a process in which the recording medium is heated by the heater device of the third embodiment in such a manner that its transferred energy amount may be maintained at a predetermined value.

First at #1 in FIG. 15, the sheet detecting sensor 60 detects that a recording medium 1 having an ink printed image formed on its surface layer 12 by means of the inkjet head 2 has been charged into the area of the heater device 4 (time: t0). At this stage, the electric heater wires 410 and the blower fans 420 of the respective heating sub-units 400 of the heater device 4 are being driven at a standard setting level so as to supply heat toward the transportation line. At a predetermined measurement time: t1, the infrared camera 190 scans the areas divided in correspondence with the matrix arrangement of the heating sub-units 400 and transmits their photographed image signals to the controller 7. Then, based on the position information of the recording medium 1 under transportation obtained by the sheet position calculating section 193 and on the photographed image signals from the infrared camera 190, the area temperature calculating section 192 designates the respective surface areas of the recording medium 1 divided like the virtually set 4×4 matrix plane and determines the surface temperatures of the respective surface areas of the recording medium 1 being heated and transported, by utilizing the densities (brightness) distribution of the respective surface areas of the recording medium 1 and a density/temperature conversion table preset therein. In succession, the transferred energy calculating section 194 multiplies the temperature obtained by the area temperature calculating section 192 with the measurement sampling interval: Δt1=t1−t10 and obtains the resultant product as the transferred energy (E1[i, j], here, i and j are 6 and 4, respectively).

Figure 16:
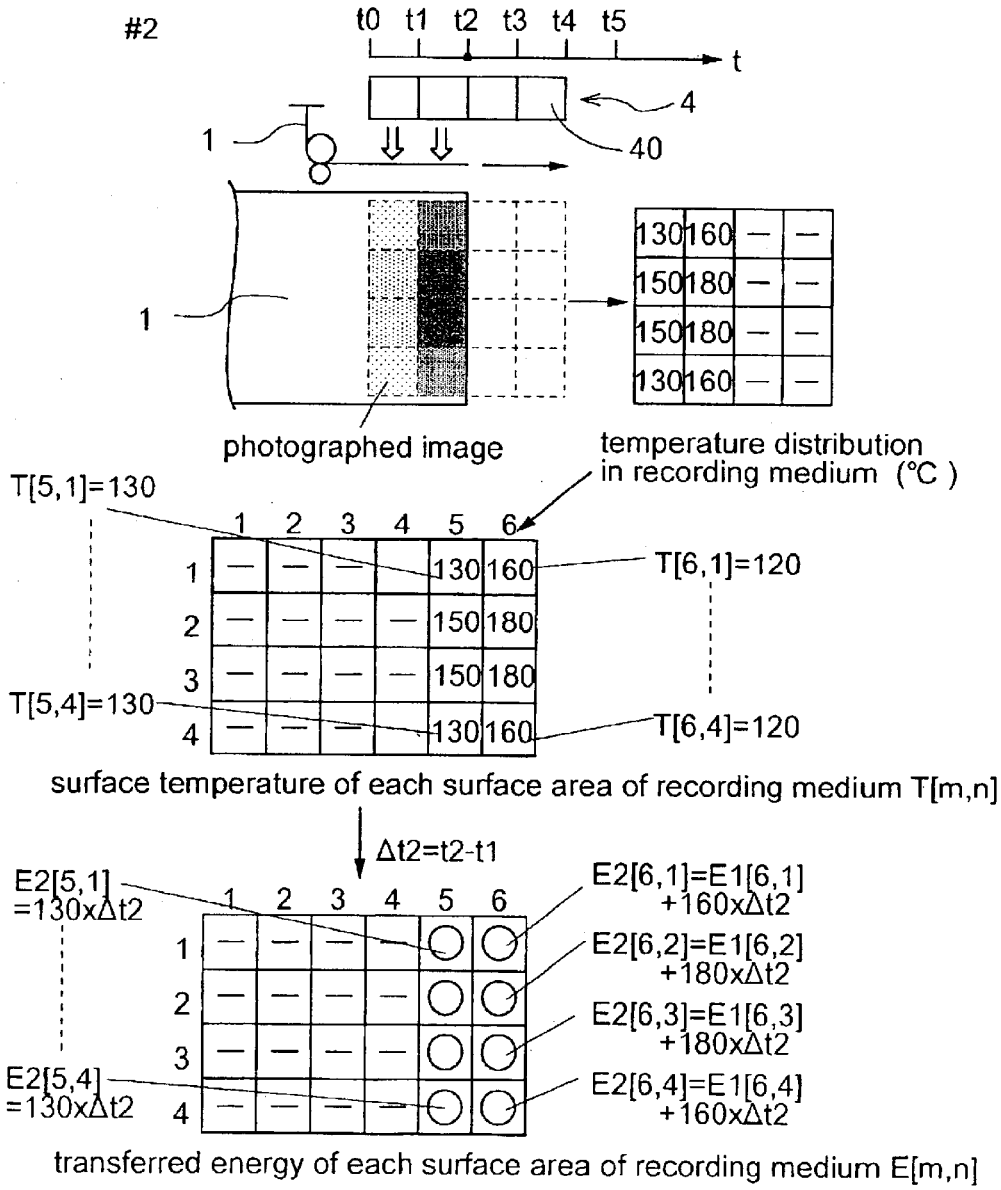
FIG. 16 is a schematic flowchart illustrating a second step of the process in which the recording medium is heated by the heater device of the third embodiment in such a manner that its transferred energy amount may be maintained at a predetermined value.

At step #2 in FIG. 16, there is shown a condition in which the recording medium 1 has advanced into the heating fixing area. At time: t2, by the method described above, the surface temperature and the transferred energy of each surface area of the recording medium 1 under heating and transportation are obtained. In the calculation of the transferred energy, the transferred energy obtained by the previous cycle is multiplied with the transferred energy obtained by the present time interval: Δt2=t2−t1 in the following manner.

$$E2[i,j]=E1[i,j]+T(m,n)\cdot\Delta t2$$

Figure 17:
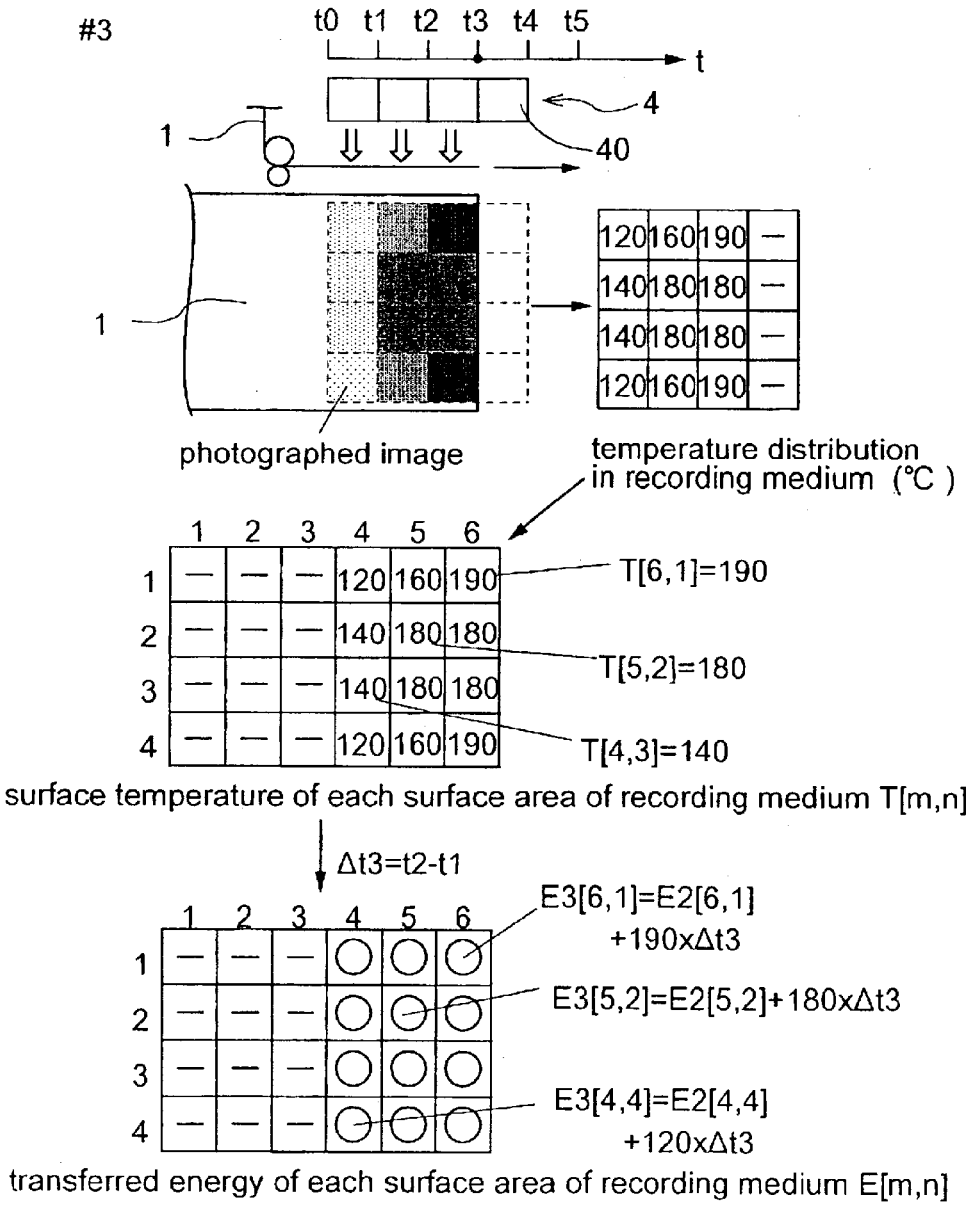
FIG. 17 is a schematic flowchart illustrating a third step of the process in which the recording medium is heated by the heater device of the third embodiment in such a manner that its transferred energy amount may be maintained at a predetermined value.

At step #3 in FIG. 17, the recording medium 1 has now advanced further into the heating fixing area, where the heating fixing process is to proceed on the area of the recording medium 1 at timing: t3, when the surface temperature and the transferred energy for each surface area of the recording medium 1 are obtained. When the transferred energy values of all the areas are checked in comparison, it is recognized that the surface temperature at the side edge area of the recording medium 1 is lower than the other areas, indicating smaller transferred energy. Therefore, the controller 7 adjusts the electric heater wire 410 and/or the blower fan 420 of the corresponding heating sub-unit 400 to supply a greater heat to this particular area. Incidentally, in selecting a heating sub-unit 400 which is to heat a particular area of the recording medium 1 being transported, such a heating sub-unit 400 will be selected which will provide the greatest heating effect on that particular area at the next sampling cycle: Δt.

Figure 18:
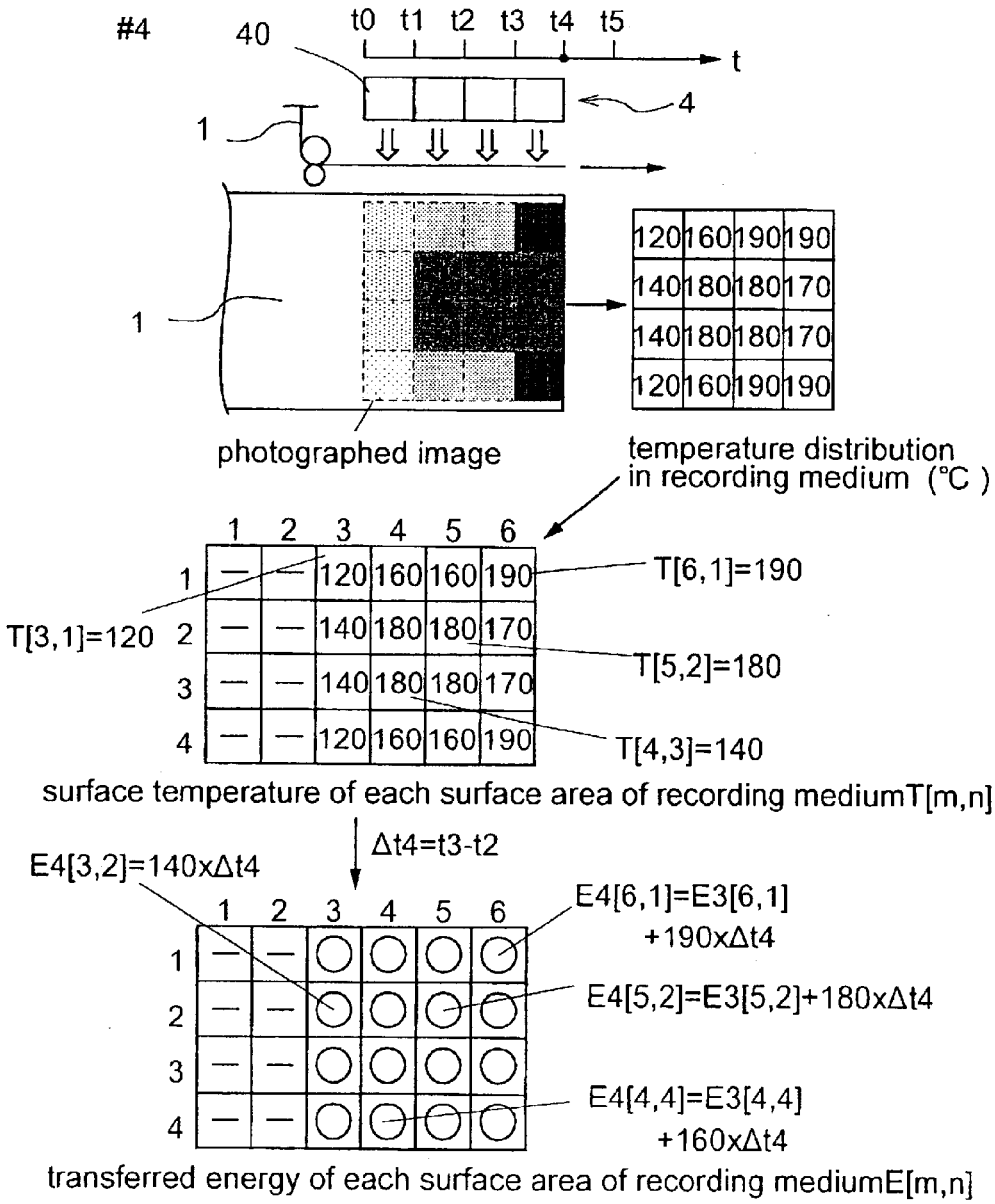
FIG. 18 is a schematic flowchart illustrating a fourth step of the process in which the recording medium is heated by the heater device of the third embodiment in such a manner that its transferred energy amount may be maintained at a predetermined value.

At step #4 in FIG. 18, while the recording medium 1 is further transported in the heating fixing area, the medium is subjected to further thermal energy from the heating sub-units 400. In this, as described above at step #3, since the heat to be generated at the heating sub-unit 400 which is to heat the side end area of the recording medium 1 was increased, at this timing interval: Δt4=t4−t3, the side edge area thereof has received the increased thermal energy. As a result, the thermal energies received by the respective areas of the recording medium 1 will tend to be substantially equal to each other.

Figure 19:
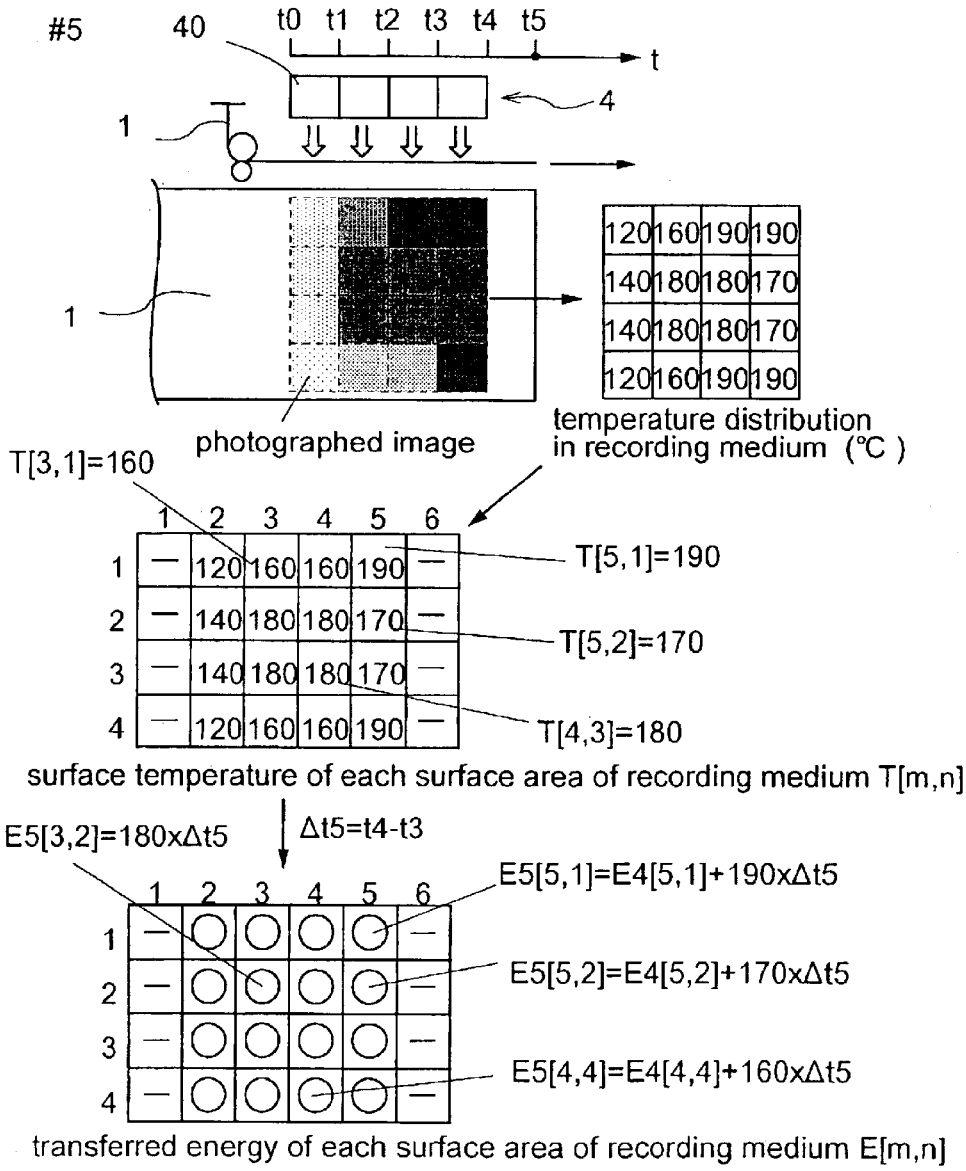
FIG. 19 is a schematic flowchart illustrating a fifth step of the process in which the recording medium is heated by the heater device of the third embodiment in such a manner that its transferred energy amount may be maintained at a predetermined value.

At step #5 in FIG. 19, as described hereinbefore, as the electric heater wire 410 and/or the blower fan 42 of each heating sub-unit 400 is feedback controlled such that the final total thermal energy received by the respective surface areas of the recording medium 1 may be a predetermined value (range) with progress of the heating fixing process. As the transferred energy suitable for sublimation and fixation of the ink applied to the surface layer 12 of the recording medium 1 employed here is about 180° C.×2 min., the control will be effected so that the final total thermal energy received by the entire surface area may be at that value. At the time: t5 of this step, the leading end area of the recording medium 1 will exit the area of the heater device 4 as the area has received substantially such final total thermal energy.

This optimal transferred thermal energy will have a variety of values, depending on the characteristics of the recording medium 1 and of the ink. In a special case, such as a case of partially using a special type of ink or using a special type of material, it will also be possible to effect the control in such a manner that the transferred heat energy of a particular area may be maintained at a transferred heat energy different from the other areas.

In these ways, according to the third embodiment, heating will be effected such that the transferred heat energy of the entire surface of the recording medium 1 bearing the print image will be uniform eventually, whereby occurrence of color irregularity or the like due to local shortage of transferred thermal energy may be restricted very effectively. Eventually, there is achieved improvement in the color development and image clearness of the image to be obtained on the final printed product 100.

In the foregoing, the transferred heat energy preset in the heating fixation of the recording medium 1 having a printed image formed thereon is maintained fixed for the entire area. Instead, it is also possible to set a different transferred energy for a particular area than the other areas.

In the second and third embodiments described above, the heating of the recording medium 1 by the heater device 4 is effected from the side of the substrate 10 of the recording medium 1. Conversely, the heating may be effected from the side of the surface layer 12 of the recording medium 1. Further, the determination of the surface temperature distribution of the recording medium 1 may be effected from either its heated side or un-heated side.

In the above regard, however, in case the substrate 10 of the recording medium 1 has a considerable thickness and its heat conductivity cannot be ignored, for more accurate direct measurement of the temperature of the surface layer 12, it is preferred that the determination of the surface temperature distribution be effected from the side of the surface layer 12.

Further, instead of the above-described construction adapted for heating the recording medium 1 having a printed image formed thereon while the medium 1 is being transported inside the heater device 4, in order to achieve the maintenance of the surface temperature distribution with even higher accuracy, it is also possible to effect the heating fixing process on the recording medium 1 while the medium is kept still inside the heater device 4.

The construction of the heater device 4 too may vary in many ways. For instance, the single blower fan 420 may be shared by at least a plurality of heating sub-units 400, preferably, by all of the heating sub-units 400. Then, by maintaining the amount of hot air to be supplied to the recording medium 1 constant and rendering the heater elements 410 incorporated in the respective heater sub-units 400 controllable independently of each other, the heat to be supplied to the recording medium 1 by each heating sub-unit 400 may be adjustable. Conversely, the plurality of heating sub-units may share a single heater element 410 (preferably, a halogen lamp or the like) to be shared by the all the heating sub-units 400. Then, by individually adjusting the amount of hot air to be supplied to the recording medium 1, the thermal energy to be supplied to the recording medium 1 may be rendered adjustable.

The fixating behavior evaluating means 9 may have other evaluating functions relating to the fixing behavior of ink than those described above. For instance, some examples of factors affecting the adjustment of the control amount to be provided to the heating controlling section 78 may include the type of the recording medium, various environmental conditions such as temperature and humidity, the type of ink, the image pattern to be formed on the fixing layer 12 and the passage speed of the recording medium 1 inside the heater device, etc.

Figure 20:
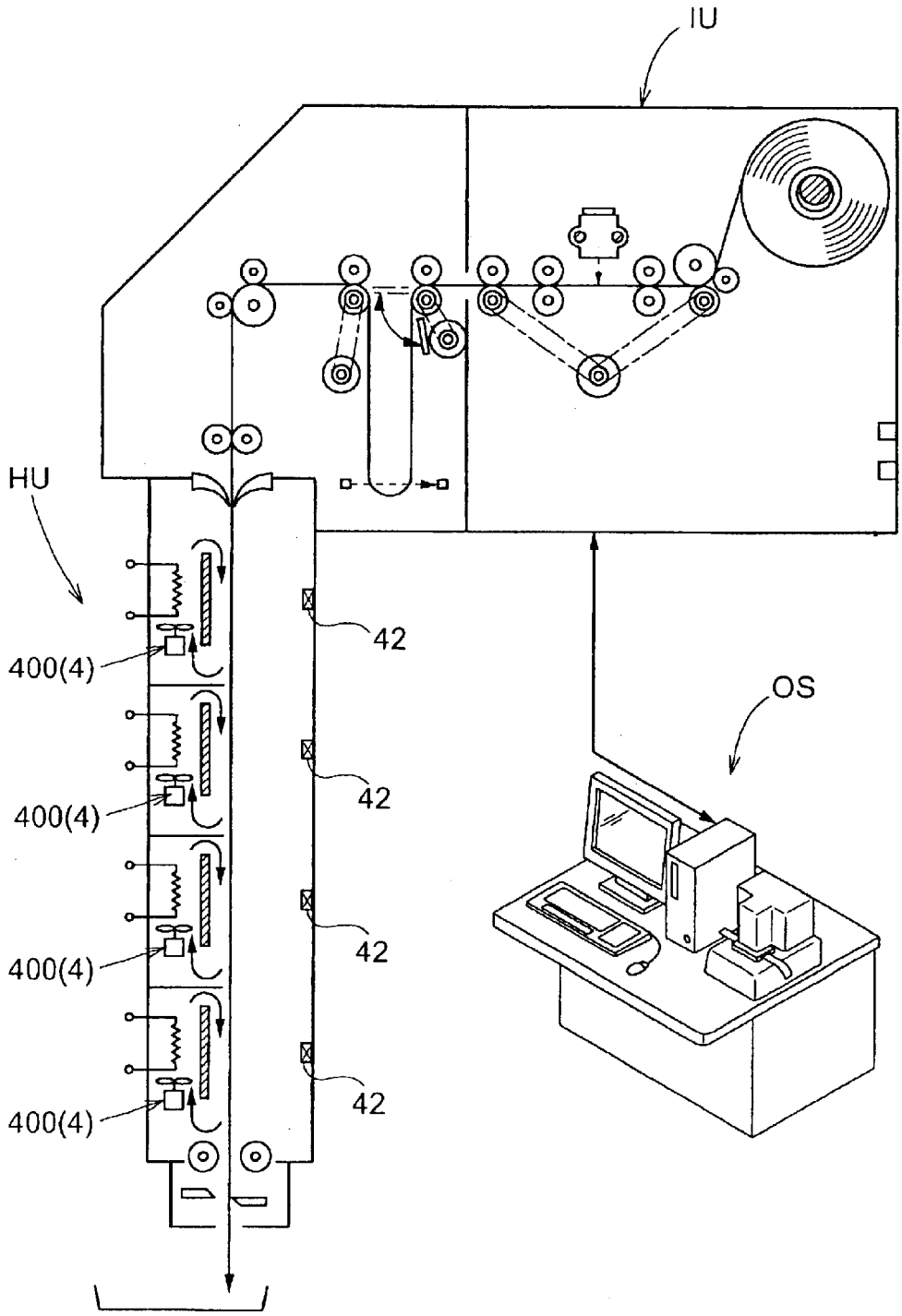
FIG. 20 is a schematic view showing a heater device according to a further embodiment.
Figure 21:
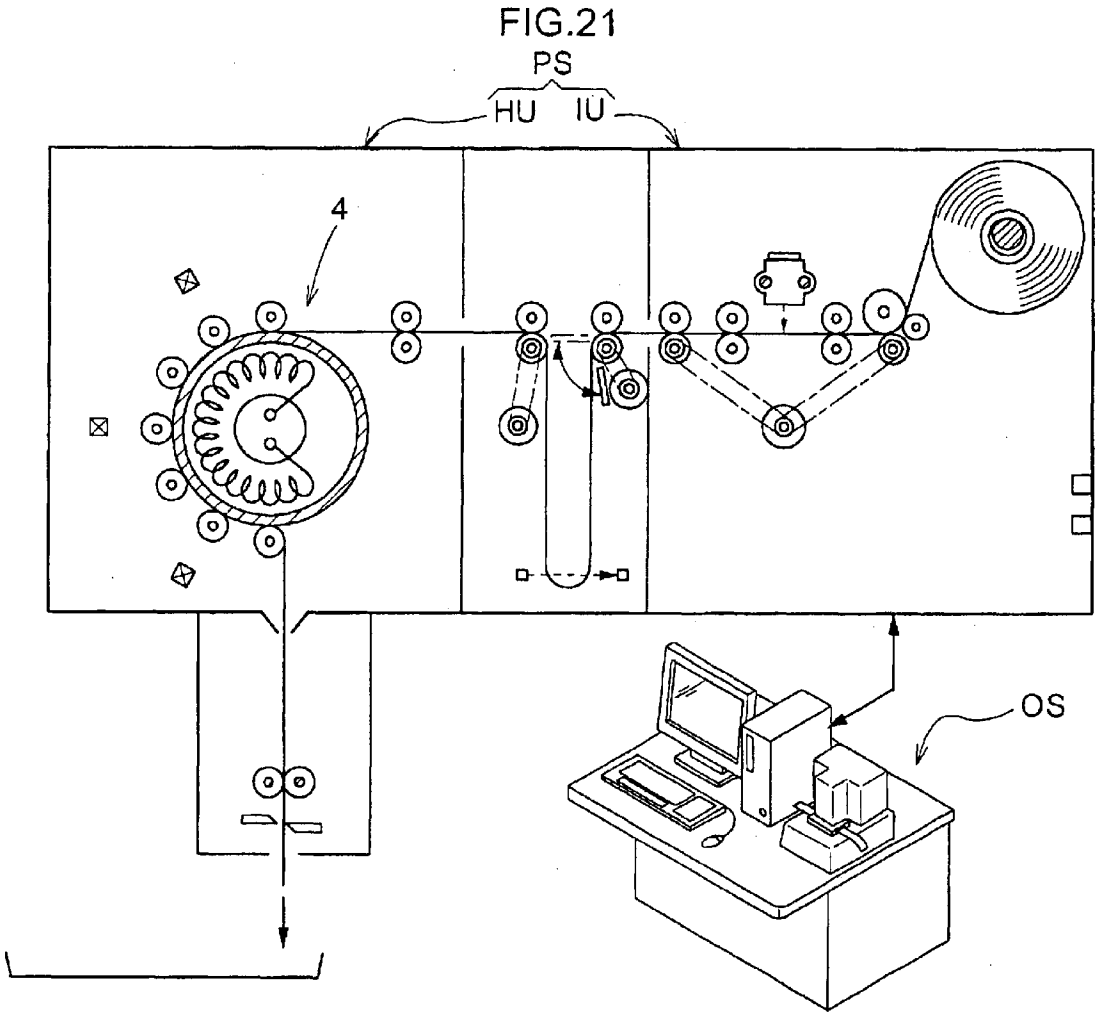
FIG. 21 is a schematic view showing a heater device according to a still further embodiment.

The construction of the heater device 4 may vary in many ways. For instance, as shown in FIG. 20, the device may be adapted for heating the recording medium which is lowered perpendicularly. Or, as shown in FIG. 21, the heater device may comprise a large-diameter heater roller type device.

The invention may be embodied in any other manner as described above. Further changes or modifications will be apparent for those skilled in the art from the foregoing disclosure within the scope of the invention defined in the appended claims.

What is claimed is:

1. An image forming apparatus for forming an image on a recording medium by heating the medium having ink applied to its surface layer by a heater device, thereby to fix the ink applied to the surface layer to a fixing layer of the recording medium, the apparatus comprising:

a heating controlling section for controlling the heater device; and a fixing behavior evaluating means for evaluating a fixing behavior of the ink to the fixing layer and then outputting a control amount to a heating controlling section for controlling the heater device, wherein the fixing behavior evaluating means includes a sublimation degree evaluating function for evaluating sublimation degree of the ink applied to the recording medium and adjusts the control amount based on the evaluated sublimation degree.

2. The image forming apparatus according to claim 1, wherein the fixing behavior evaluating means adjusts the control amount depending on the type of the recording medium.

3. The image forming apparatus according to claim 1, wherein said sublimation degree evaluation is realized by a sublimation degree calculating section for calculating the sublimation degree based on a density value of print dot obtained by an image pickup device for photographing the print dot formed on the recording medium.

4. The image forming apparatus according to claim 1, wherein the recording medium is caused to stay inside the heater device until an appropriate sublimation degree is obtained.

* * * * *